US005167271A

United States Patent [19]

Lange et al.

[11] Patent Number: 5,167,271

[45] Date of Patent: Dec. 1, 1992

[54] METHOD TO PRODUCE CERAMIC REINFORCED OR CERAMIC-METAL MATRIX COMPOSITE ARTICLES

[76] Inventors: Frederick F. Lange, Santa Barbara, Calif.; Robert Mehrabian, Santa Ynez, Calif.; Anthony G. Evan, Santa Barbara, Calif.; Bhaskar V. Velamakanni, Goleta, Calif.

[73] Assignee: The Regents of the University of Calif., Oakland, Calif.

[21] Appl. No.: 260,507

[22] Filed: Oct. 20, 1988

[51] Int. Cl.[5] ..... B22D 19/00

[52] U.S. Cl. ..... 164/103; 164/98; 164/105; 264/44; 264/59

[58] Field of Search ..... 264/44, 57, 59; 164/98, 164/103, 105

[56] References Cited

U.S. PATENT DOCUMENTS

| | | | |
|---|---|---|---|
| 4,056,586 | 11/1977 | Pryor | 264/44 |
| 4,461,842 | 7/1984 | Jamet | 501/95 |
| 4,525,337 | 6/1985 | Jamet | 423/449 |
| 4,604,249 | 8/1986 | Luhleich | 264/60 |
| 4,868,143 | 9/1989 | Newkirk | 264/60 |

OTHER PUBLICATIONS

M. S. Newkirk et al., Journal of Materials Research, vol. 1, No. 1, pp. 81-89, (Jan. Feb., 1986).

J. F. Jamet et al., "Pressure Slip Coasting of Ultrafine Powders A Promising Process for Ceramic-Ceramic Composites", ICAS Proceedings 1986: 15th Congress of International Council of Aeronautical Sciences, #10936, Sep. 7-12, 1986, pp. 553-569.

*Primary Examiner*—James Derrington

[57] ABSTRACT

The present invention relates to processes to produce ceramic reinforced and ceramic-metal matrix composite articles. More specifically, the invention concerns the use of pressure filtration to infiltrate a reinforcing organic or inorganic network with ceramic particles. Centrifugation is also used to separate the liquid form the slurry. After heating the reinforced ceramic article is produced. Pressure filtration is also used to infiltrate an organic polymer or organic fiber network with ceramic particles. The solvent is removed carefully followed by intermediate heating to remove the organic network without deforming the preform shape. After densification, the preform is heated and contacted with molten metal (optionally) with pressure to infiltrate the open channel network. Upon cooling the ceramic metal matrix composite is obtained. The reinforced matrix articles are useful in high temperature and high stress applications, e.g., combustion chambers, space applications, ceramics for bathroom fixture use, and the like. A significant advantage of this process is its ability to manipulate the architecture as well as the amount of metal reinforcement in the composite as per specifications. Moreover, one can choose different metal-ceramic reinforcements as per the processing needs.

31 Claims, 11 Drawing Sheets

METHOD TO PRODUCE CERAMIC REINFORCED OR CERAMIC-METAL MATRIX COMPOSITE ARTICLES

ORIGIN OF INVENTION

This invention was made with U.S. Government support under Contract No. N00014-86-K-0753 awarded by the Department of the Navy (U.S. Defense Advanced Research Projects Agency Office of Naval Research). The U.S. Government has certain rights in this invention.

BACKGROUND OF INVENTION

1. Field of Invention

The present invention relates to ceramic reinforced and ceramic metal matrix composite articles and the processes to produce them. Specifically, the present invention relates to a process using pressure filtration for forming a ceramic article which is reinforced using organic or inorganic materials. An article having improved physical properties is produced when the organic material is removed, and the open channels are filled with a metal. The invention also relates to ceramic articles having an internal metal network throughout the composite.

The reinforced ceramic composite article and the ceramic metal matrix composite article of the present invention have a number of uses including but not limited to pump components, valve components, armor, rocket engine components, piston engine components, industrial heat exchangers, aerospace components, gas turbine engine components, blasting nozzles, gun system components, high temperature engine components, storage battery plates, biomedical implants, dental systems, coatings (impact and thermal protection), and the like.

2. Description of Related Art

Reinforced Ceramic Articles—Ceramic, metallic and polymeric materials are reinforced with either whiskers (strong single crystals with an aspect ratio (length to diameter) usually greater than 10 or strong fibers to achieve superior mechanical properties. It is generally believed that refractory ceramics reinforced with either fibers or whiskers will be required for advanced heat engines and other high temperature structural and space exploration applications.

The manufacture of these composites requires incorporating the reinforcing agent (i.e. whisker or fiber) into the matrix material, or conversely, incorporating the desired matrix material into a preform of the desired reinforcing agent. The latter method, i.e., incorporating the matrix material into a reinforcing preform, is required when a composite with either three dimensional or isotropic reinforcement is desired (as opposed to fibers/whiskers aligned in one dimension or two dimensions).

Reinforcing preforms are a self supporting fiber (or whisker) network, which usually comprise between 10 to 50 volume percent of the preform, with the remainder volume comprised of continuous void space. Reinforcement preforms can be manufactured by a number of different techniques. For example, three dimensional weaving technology has advanced to the stage where strong, continuous fibers can be woven in a variety of shapes. Discontinuous fibers and whiskers can also be "felted" to produce preform blocks which are cut into desired shapes.

Filling the void phase within the reinforcing preform without degrading the fiber/whisker material currently presents one of the greatest problems in producing composites with a refractory, ceramic matrix. Because refractory ceramics have very high melting temperatures, very few ceramics can be forced into the preform as a molten liquid without degrading the preform material as done for many metallic and polymeric matrices. The current method of incorporating the ceramic is to infiltrate the preform with a gaseous precursor that decomposes within the interior to coat and partially fill the preform with the desired ceramic. Gas infiltration must be carried out at very low pressures to avoid flow channels connecting the exterior from clogging. Because of the low pressure requirement, composite processing requires very long processing periods (of the order of days). In addition, the chemistry, composition and microstructure of the ceramic matrix is limited to those that can be produced by vapor phase deposition/reaction. Thus, the manufacture of ceramic matrix composite materials is severely limited by present processing technology.

Ceramic-Metal Composites—Ceramics presently have limited engineering applications due to their inherent brittleness and catastrophic failure. However, the fracture toughness of ceramics enhance significantly by incorporating ductile (e.g., metal) second phases into the ceramic matrix. When the ductile, metal phase is in the path of the crack, the metal deforms plastically and exerts traction on the crack surfaces which, in turn, inhibit the crack opening and hence, increases the overall toughness of the ceramic body.

At present, the major problem in toughening ceramics with ductile metals is with making the ceramic-metal composite. Useful ceramic matrices are formed with powders that must be densified at very high temperatures. A conventional method of producing metal reinforced ceramics is to mix the metal fiber with the ceramic powder and densify the powder/fiber mixture at high temperatures under an applied pressure. An applied pressure is required because the metal reinforcement constrains the densification of the ceramic powder. In this conventional method, the fiber must not melt prior to matrix densification otherwise the metal fibers lose their shape when they melt and are squeezed into the partially dense ceramic powder. The conventional method is limited to very refractory metals which do not melt prior to matrix densification. Although refractory metal fibers may not melt, two other problems are encountered, i.e.:

(a) refractory metal reinforcements lose their shape during processing by plastic deformation, and (b) because ceramic densification periods are long, they react with the ceramic to form unwanted compounds. Thus, the present conventional methods of making ceramic/metal composites require the application of pressure to ceramic powder-metal reinforcement mixtures at high temperatures, and are, therefore, limited to refractory metals that do not react with the ceramic matrix during processing.

All references cited in this application are incorporated herein by reference, including but not limited to:

J. F. Jamet, et al., *L'Aeronautique et l'Astronautique*, Vol. 2/3, No. 123/124, p. 128-142 (1987);

M. S. Newkirk, et al., *Journal of Materials Research*, Vol. 1, No., p. 81-89 (Jan./Feb., 1986).

Also see, for example, J. Jamet, et al., French Patent No. 2,526,785, dated Nov. 18, 1983;

J. Jamet, U.S. Pat. No. 4,461,842, dated July 24, 1984; and

J. Jamet, et al., U.S Pat. No 4,525,337, dated June 6, 1985.

J. Jamet, et al., French Patent No. 2,526,785 issued Nov. 18, 1983.

J. F. Jamet, et al., "Pressure Slip Casting of Ultrafine Powders A Promising Processing for Ceramic-Ceramic Composites." ICAS Procedings 1986: 15th Congress of International Council of Aeronautical Sciences, #10936, Sept. 7 to 12, 1986.

A new method is necessary to form a dense ceramic which is reinforced and also a ceramic containing channels in which molten metal is infiltrated to form a desired three dimensional pattern of metal reinforcement upon cooling. The new method, as described hereinbelow, not only avoids the problems of conventional processing, but also broadens the range of different ceramic/metal composites that can be produced.

SUMMARY OF THE INVENTION

The present invention relates to a method for forming a dense ceramic-metal matrix article, which comprises:

(a) combining using pressure filtration, a liquid slurry of a ceramic powder, and a pyrolyzable moiety selected from:,
  (i) an open cell reticulated organic polymeric foam, or
  (ii) an organic fiber preform, either of which form an innerconnected organic network within the ceramic-fiber powder compact produced;

(b) removing the liquid portion of the powder compact of step (a) under conditions effective to remove the liquid without disrupting the shape or mechanical integrity of the ceramic powder-organic moiety compact;

(c) removing the pyrolyzable moiety by heating the ceramic powder-organic compact moiety at elevated temperature conditions effective to remove the organic moiety without disrupting the shape or mechanical integrity of the ceramic powder compact thus producing an interconnected network of open channels in the ceramic powder compact;

(d) densifying the ceramic powder compact by heating at a temperature effective to densify the powder without eliminating the open channels;

(e) heating the densified ceramic preform of step (d) to a temperature effective to prevent thermal shock when next contacted with sufficient molten metal to effectively fill the open channels;

(f) optionally using increased pressure to facilitate the molten metal intrusion into the open channels; and (g) cooling the formed ceramic-metal matrix article.

More specifically, the present invention relates to an improved method for forming a dense ceramic-metal matrix article, which method comprises:

(a) combining a composition itself comprising,
  (i) a liquid,
  (ii) an ceramic powder, and
  (iii) a surfactant, (b) filtering the composition of step (a) using pressure through a pyrolyzable moiety selected from an open cell organic polymeric foam or an organic fiber under conditions to produce a ceramic-fiber powder compact having an innerconnected organic network;

(c) removing the liquid remaining in the powder compact at an effective temperature below the boiling point of the liquid without disrupting the shape or mechanical integrity of the ceramic powder-organic moiety compact;

(d) removing the pyrolyzable moiety at a temperature of between about 200° and 800° C. under conditions effective to remove the organic moiety without disrupting the shape or mechanical integrity of the ceramic powder compact thereby producing an innerconnected network of open channels within the ceramic powder compact;

(e) densifying the ceramic powder compact of step (d) by heating at between about 1000° and 2100° C. under conditions to densify the powder compact without eliminating the open innerconnected channels, (f) heating the densified ceramic preform of step (e) to an elevated temperature effective to prevent thermal shock when next contacted with sufficient molten metal to effectively fill the open channels;

(g) contacting the heated densified preform of step (f) with heated molten metal;

(h) optionally employing increased external pressure of between about 1 and 100 MPa to facilitate the intrusion of the molten metal into the open channels of the densified preform; and (j) cooling the formed ceramic-metal matrix article.

The invention also relates to an improved method for forming a reinforced ceramic article, which method comprises:

(a) combining using pressure filtration a liquid slurry of a ceramic powder, and either a reinforcing carbon preform or an inorganic- preform, having percolation channels to produce a reinforced ceramic powder compact;

(b) removing the liquid portion of the powder compact of step (a) under conditions effective to remove the liquid at a temperature below the boiling point of the liquid without disrupting the shape or mechanical integrity of the reinforced ceramic powder compact; and (c) strengthening the ceramic powder compact by heating at a temperature effective to densify the powder without disruption of the shape or mechanical integrity of the reinforcing particles.

The articles having improved properties formed by the processes described herein are also considered to be a part of the present invention.

BRIEF DESCRIPTION OF THE DRAWINGS

FIG. 3 shows a three dimensional network as a micrograph of a reticulated polymer foam.

DETAILED DESCRIPTION OF THE INVENTION AND PREFERRED EMBODIMENTS

Definitions

Figure 1:
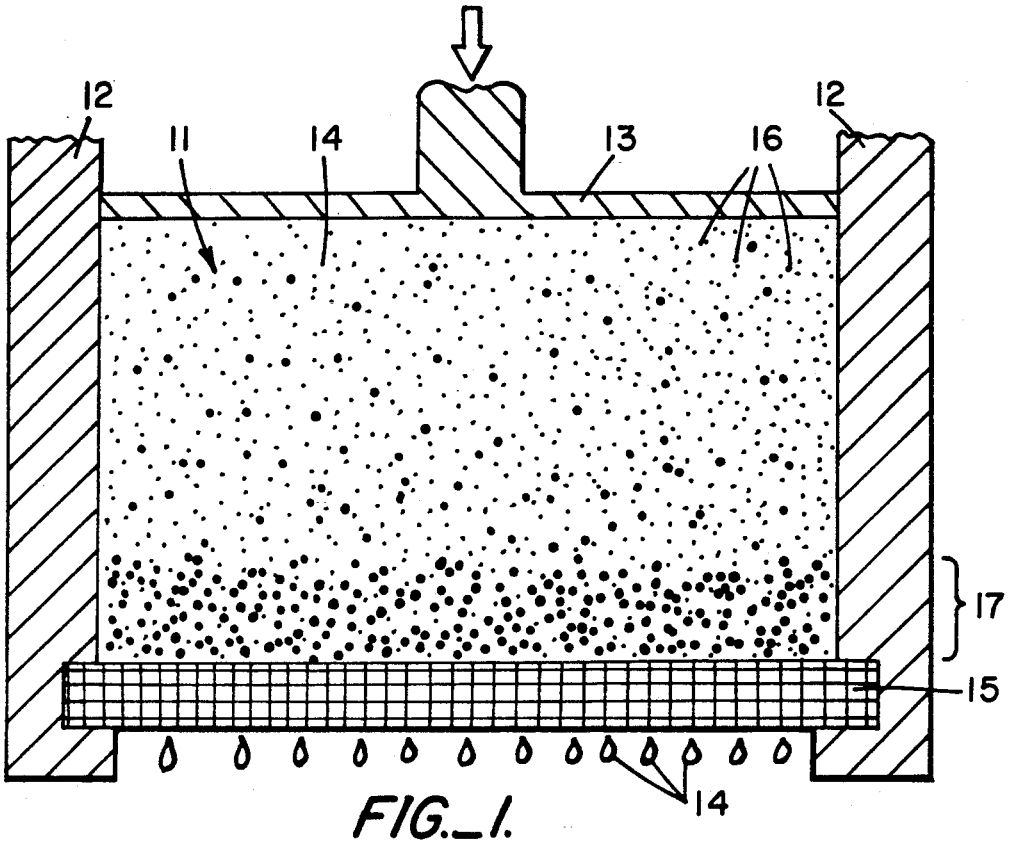
FIG. 1 is a schematic representation of the pressure filtration as a method to form an engineering shape.

As used herein:

"Metal" refers to solid elemental material that exhibit luster, malleability, and thermal conductivity over a range of temperatures, preferably above 50° C.

"Metal alloy" refers to a metal containing, including but not limited to, binary, ternary, quarternary and pentanary metal element systems generally exhibit low melting temperatures and superior mechanical and electrical properties when compared to that of a single metal.

"Optional" or "optionally" means the subsequently described event or circumstance may or may not occur, and that the description includes instances where said event or circumstance occurs and instances in which it does not. For example, "optionally substituted phenyl" means that the phenyl may or may not be substituted and that the description includes both unsubstituted phenyl and phenyl wherein there is substitution; "optionally followed by heating" means that said heating may or may not be carried out in order for the process described to fall within the invention, and the invention includes those processes wherein the heating occurs and those processes in which it does not.

"Preform" refers to an article having either a two or three dimensional network having porosity/voidage between about 2-60% formed by organic or inorganic materials, including but not limited to, fibers, whiskers, particles and platelets. Two different kinds of preforms (articles) are used in this invention, therefore it is necessary to define the term "channel" for each case. The first kind of preforms are commercially available (such as polymer foams, carbon felts, carbon fibers, and saffil alumina preforms). The second kind of preform is processed in the laboratory for making ceramic-metal matrix composite articles The first kind of preforms which are mainly used in pressure filtration of slurries are characterized to have percolation channels or pores with a wide variation in size distribution. On the other hand, the second type of preforms (which are used to infilter molten metal) that consist of densified ceramic with channels are characterized by having open channels or pores of definite geometry (i.e. size and shape) and narrow size or shape distribution. Metal Reinforced Ceramic Composite—A ceramic powder is packed within a commercially available open cell, polymer form (reticulated foam) by pressure filtration. The reticulated foam defines a connective network for metal intrusion once it is removed (burned away) with a relatively low temperature heat treatment. After the connective polymer network is removed by heat treatment, the powder compact, containing the desired channels, is then densified using high temperature heat treatment. It is observed that the channel network, remnant of the polymer, decreases in all dimensions consistent with the shrinkage of the powder during densification. Polished and fractured specimens show that the channel network is retained after densification. Molten metal is then infiltrated into the open, continuous channels to form a ceramic matrix-containing the desired network of metal reinforcement, FIG. 2D.

A second embodiment is also described to incorporate the continuous, channels in a ceramic for subsequent metal infiltration. In this method, chopped fibers of organic materials, e.g., carbon fibers, polymer fibers, etc., are directly mixed into the ceramic powder slurry. The chopped fibers and powder are consolidated together by pressure filtration. During consolidation, the chopped fibers form a touching network. The ceramic powder packs within the percolation channels created by this touching network. After the organic fibers are removed by a heat treatment, a connecting pore channel network is formed which is available for molten metal infiltration.

The key combined features of this invention are:

(a) a ceramic powder is packed either within or around a network of a second material by pressure filtration, (b) after powder packing, the network material is removed to define a continuous network of pore channels, (c) after the network material is removed, the powder compact is made dense by a high temperature heat treatment, and (d) after densification of the ceramic matrix, molten metal can be intruded into the network channels to create the desired reinforcement network configuration.

Figure 3A:
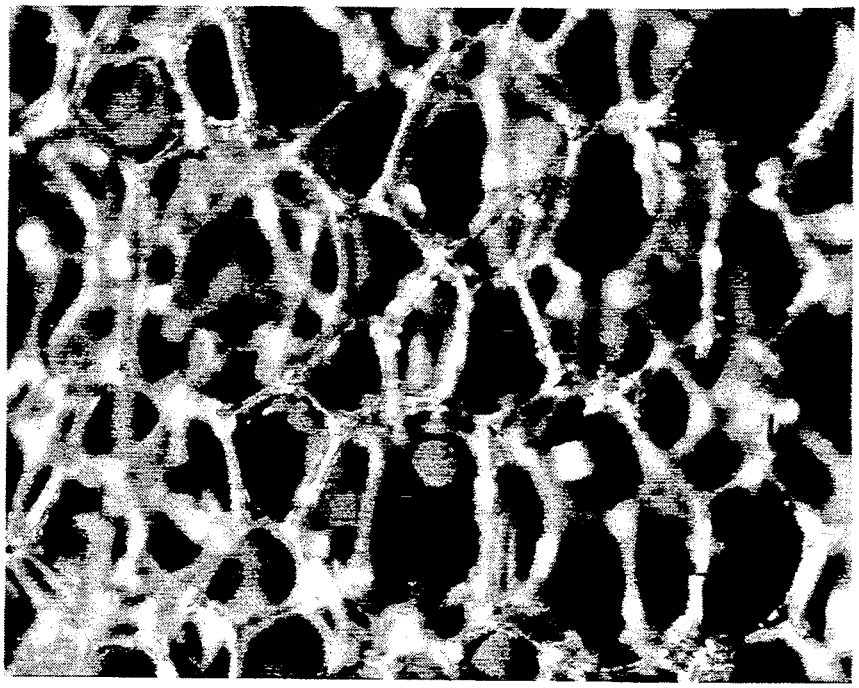
FIG. 3A is a reflected light optical micrograph.
Figure 3B:
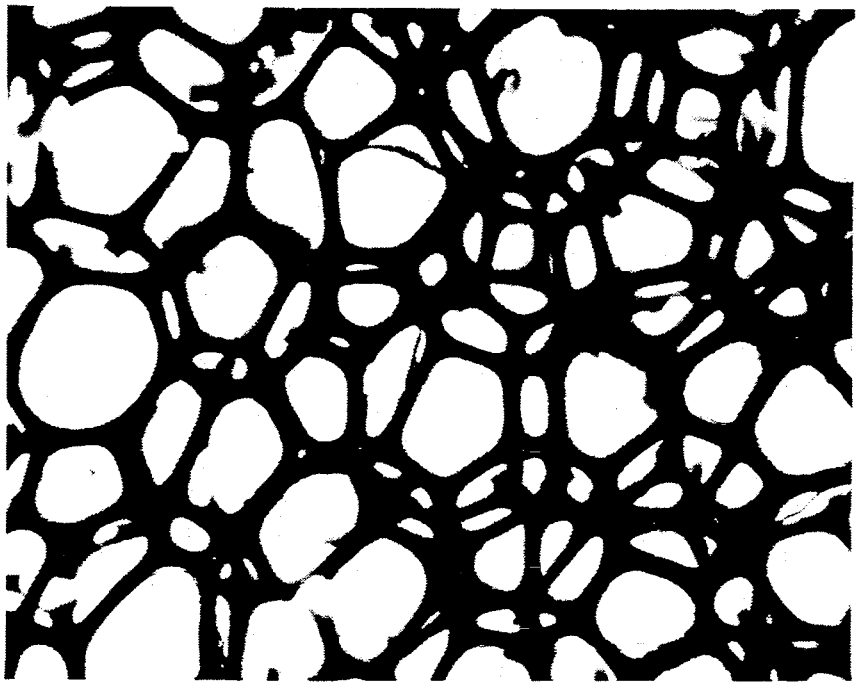
FIG. 3B is a transmitted light optical micrograph of the foam.

An example of three dimensional network is shown in FIG. 3, which is a micrograph of a reticulated, polymer foam.

Three processing conditions are important:

1. The ceramic particles should be between at least 7–10 1times smaller or more than the percolation channels within the organic foam network. Such a size ratio requirement is needed as to prevent the network from acting as a filter and clogging prematurely. The particles are generally less than 10 microns in diameter, preferably less than 5 microns, especially less than 1 micron 2. The particles cannot be attracted to themselves (should not floc) or to the network material as they flow through the network channels. If the particles are attracted to the network material, they quickly block the channels. When this attractive condition prevails, the network itself acts as the filter and a consolidated layer builds up on top of the preform instead of on the surface adjacent to the filter at the bottom. Thus, this step requires that repulsive surface forces must also exist between the particles themselves to prevent agglomerated particles from blocking the preform channels. Surfactant/liquid systems are disclosed so that the repulsive forces between the particles and the between the particles and network material prevail. If the flow channels within the polymer network are very large (e.g., like those shown in FIG. 3) flocced slurries can be used.

3. The applied pressure used to consolidate the powder within the network material should not disrupt (or crush) the polymer or fiber network. The absence of this unwanted condition is already inherent to pressure filtration. Before a consolidation layer builds up on the filter, a uniform pressure exists within the slurry and within the fluid filling (or slurry filled) network. That is, the network is not subjected to a pressure gradient and therefore does not support non-hydrostatic loads. When a consolidated layer builds up within the network, the pressure exerted by a consolidated layer on the network is identical to the pressure within the slurry. Thus, throughout all stages of pressure infiltration, the network is never subjected to non-hydrostatic loads which would produce disruptive effects (e.g., network compaction, deformation, and/or crushing). The pressure in generally between about 1 atmosphere and 30 MPa, preferably between 2 atmospheres and 30 MPa.

Pressure Filtration—Pressure filtration is an infrequently used method of consolidating powders. It is best described by FIGS. 1 and 2A, which shows a slurry 11 (of liquid 14 and particle 16) confined within a cylinder 12 acted upon at one end by a plunger 13 which forces the fluid 14 within slurry 11 through a filter 15 at the other end. Repelling particles 16 within slurry 11 flow through the percolation channels 15A are trapped at filter 15 to build up a consolidated layer 17 as fluid 14 is forced through the layer 17 and then through the filter 15. Pressure filtration concentrates the particles within the slurry to form a layer 17 consisting of densely packed particles. Suitable examples ceramic powders are found in Table 1 below.

TABLE 1

| | Ceramic Matrix Materials | | | | |
|---|---|---|---|---|---|
| Metal Base | Carbides | Nitrides | Borides | Oxides | Applications |
| Boron | B4C | BN | | | Aerospace |
| Tantalum | TaC | TaN | TaB2 | | Aerospace |
| Zirconium | ZrC | ZrN | ZrB2 | ZrO2 | Aerospace |
| | | | | ZrO2(T) | Automotive |
| | | | | | Neuclear |
| Hafnium | HfC | HfN | HfB | HfO2 | Aero, Neuc |
| Aluminum | | AlN | | Al2O3 | Automotive |
| | | | | | Neuclear |
| Silicon | SiC | Si3N4 | | | Aerospace |
| | | | | | Automotive |
| Titanium | TiC | TiN | TiB2 | | Aerospace |
| Chromium | CrC | | CrB2 | CrO2 | Aerospace |
| | | | | | Automotive |
| Molybdenum | MoC | | MoB | | Aerospace |
| | | | | | Automotive |
| Tungsten | WC | | WB | | |
| Thorium | ThC2 | ThN | | ThO2 | Aerospace |

Silicides: NbSi, FeSi etc, as well

After a single layer of particles is trapped by the filter, the trapped particles themselves become the filter through which fluid must flow to trap more particles. The consolidated layer thickens in proportion to the amount of slurry filtered. Consolidation stops when the layer thickens, and the top encounters the plunger 13. At this point, all of the particles 14 which were initially in the slurry 11 are densely packed within the consolidated body and space left within the densely packed particles is filled with liquid. The consolidated body (powder preform 12) is then removed from the cylinder and so that the liquid can be removed by careful evaporative drying.

Figure 2A:
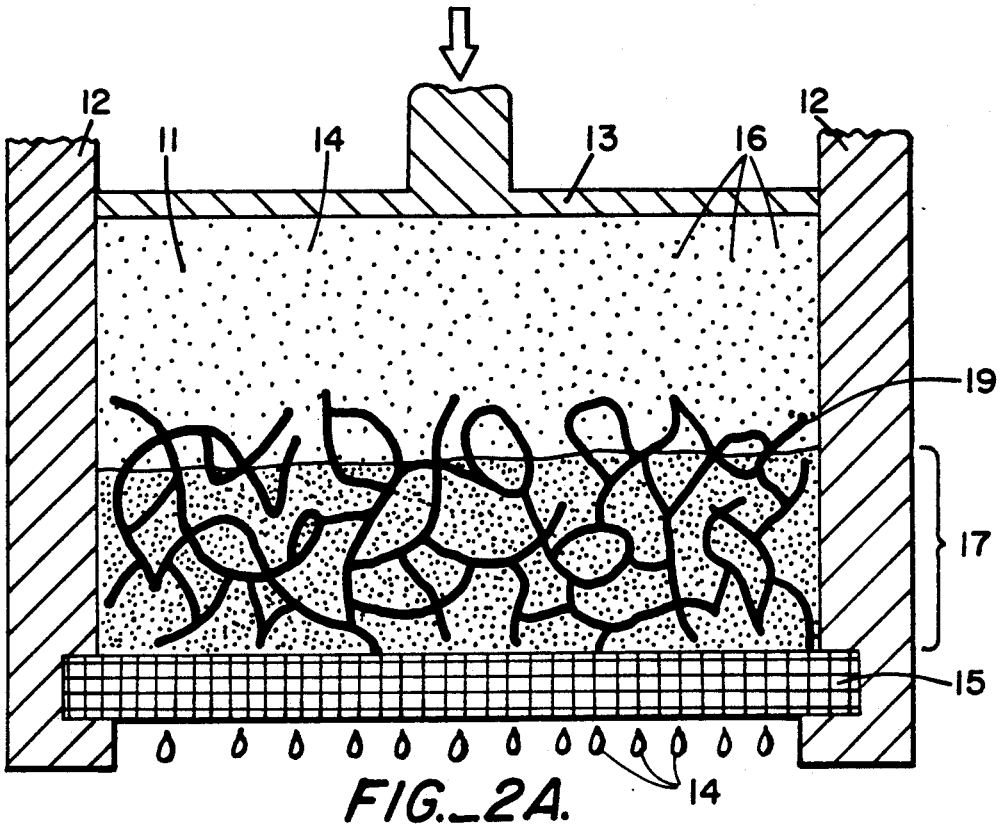
FIG. 2A is a schematic representation for packing a powder within a touching network by pressure filtration.

Although the schematic shown in FIG. 1 or 2A only produces a simply shaped body 2B, i.e. a disc, pressure filtration can be used to form complex articles, for example, for space and aerospace use, shaped sanitry ware, e.g., sinks, toilet bowls, bath tubs, and the like.

Not wanting to be bound by theory, it is submitted that the time dependent law governing the thickening of the consolidated layer was described by Darcy. Darcy's Law relates the viscosity of the fluid, the permeability of the consolidated layer (resistance it imposes to fluid flow), and the pressure applied to the slurry for the time required to form a consolidated layer desired thickness. Preferably the temperature is between the freezing point and the boiling temperature of the liquid and the time is between about 0.01 and 24 hr. Especially preferred is a temperature of between about 10° and 40° C. and a time of between about 0.03 and 1 hr. Higher pressures result in shorter consolidation periods. The permeability of the consolidated body depends on how dense the particles pack. Observations show that repulsive interparticle forces lead to the highest and thus, optimum packing density that can be achieved with a given powder and that the packing density is not dependent on the applied pressure.

Incorporating Pore Channels into a Ceramic by Pressure Filtration

Method 1: Pressure Filtration into a Three Dimensional Network—Using a similar schematic used to explain pressure filtration, FIG. 2A shows how a powder 16 is introduced and packed within a network to make of a second material, e.g., a network 19 in contact with filter 15 that can be removed with a low temperature heat treatment. As shown, the network 19 is placed on top of the filter 15 within the cylinder 12 and filled with the same fluid 14 and surfactant used in making the slurry. Network can be partially glued or wedged, or mechanically secured to filter 15. Slurry 11 is then poured into the cylinder 12 and pressure filtration is initiated by applying a force to the plunger 13. During pressure filtration, the consolidated layer 17 builds up within the polymer network 19 in the same manner described above for the case without the network in FIG. 1.

Solid polymers include, for example, polyurethane, polystyrene, polyethylene, polypropylene polyester, polyamide and the like. Polyurethane is preferred.

Figure 4:
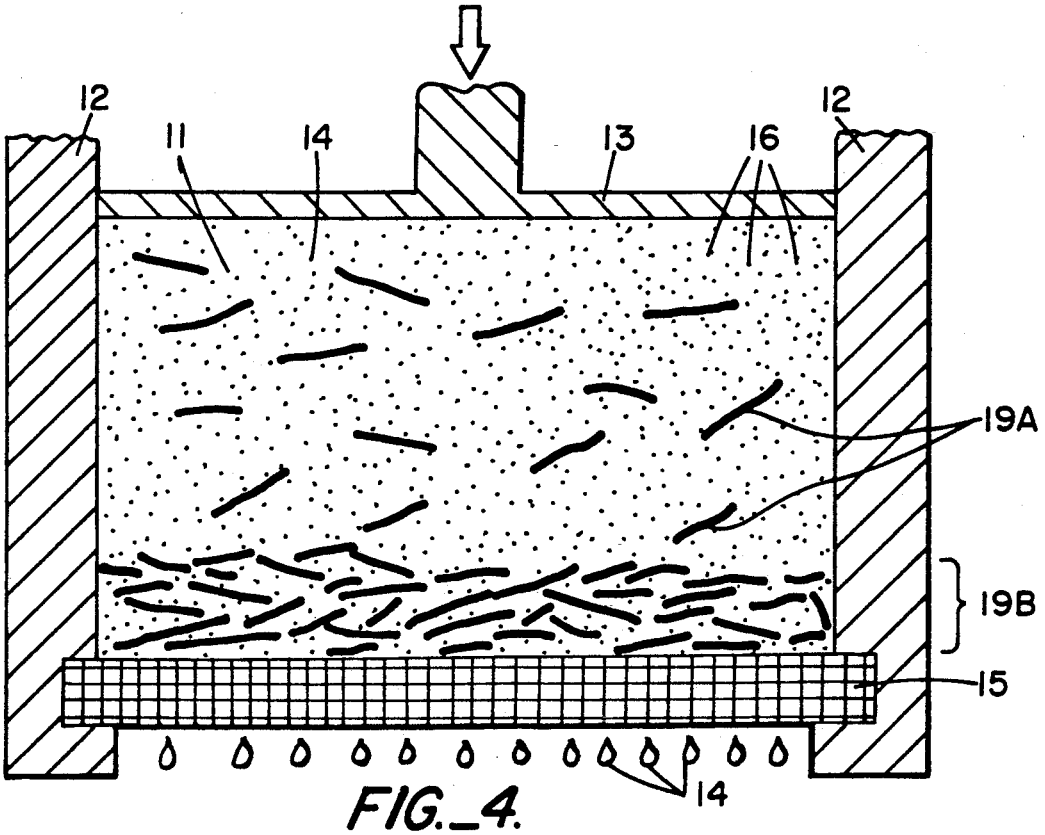
FIG. 4 is a schematic representation of FIG. 1 where chopped fibers are mixed with the slurry.

Method 2: Network Formation During Pressure Filtration FIG. 4 illustrates that chopped, organic fibers 19A are mixed into a powder slurry 11, and that the mixture is pressure filtered to form a consolidated body containing a continuous network of chopped fibers surrounded by packed powder 19B. The difference between the art method and that described hereinabove is that the network is irregular. It is also observed that the chopped fibers 19A more or less align during consolidation as schematically illustrated in FIG. 4.

Not wanting to be bound by theory, it appears that when a powder is mixed with a liquid, Van der Waals forces generally cause the particles to attract one another causing the particles to form a continuous, low density, agglomerated network. When attractive interparticle forces dominate, the volume fraction of powder that is mixed with the fluid before it turns into a paste is limited (usually less than 15 volume percent). Additives, e.g. surfactants, are introduced into the powder/fluid slurry to produce repulsive forces between particles that overcome the attractive, Van der Waals forces. With additions of the proper surfactant, repulsive interparticle forces dominate, particles repel one another, and pourable slurries containing large volume fractions (up to 55%) of the powder can be made.

Suitable surfactants include, for example, soaps, alkyl sulfates, alkyl sulfonates, alkyl phosphates, primary amine salts, quarternary ammonium salts, sulfonium salts, alkyl pyridinium salts, and the like. Alkyl groups herein have 1 to 20 carbon atoms.

Repulsive interparticle forces can be produced within a slurry with either an electrostatic approach, the steric approach or a combination of the two. Hence particles can be made to repel each other with the proper selection of solvent. The solvation force can be decreased via the addition of molecular species which disrupt the ordered structure at the particle surface which subsequently leads to small local density changes around the particle.

In the electrostatic approach, to obtain proper repulsive forces, ions are attracted to or dissociated from the particle surfaces to produce a system of similarly charged particles which repel one another due to Coulombic forces. For this case, the surfactant can be either an acid or a base which controls the concentration of $H^+$ or $OH^-$ ions within the fluid and therefore the concentration gradient of these ions near the particle/fluid interface. With the steric approach, bi-functional macromolecules attach themselves to the particles. The macromolecular additive is the surfactant, which is completely soluble in the fluid, but are designed with certain functional groups to bind them to the particles. When particles approach one another, the macromolecules bound to the surface repel those bound to the approaching particle, producing repulsive interparticle forces. The electrostatic and steric approaches can be combined with surfactants, known as polyelectrolytes. Polyelectrolytes are macromolecules that become charged when introduced into the proper fluid. Polydispersants include, for example, polyethylene oxide, polyacrylamide, polyacrylic acid, hydrolyzed polyacrylamide, polystyrene sulfonate, Methocel (from Dow Chemical Company, Midland, Mich. 48640), polydiallyldimethylammonium, and the like.

The amount of surfactant required to produce repulsive interparticle forces depends on the type of surfactant and the surface area of the ceramic powder. In general the amount is between about 0.1 and 5 weight percent, preferably between about $0_{,}1$ to 2 weight percent, of the ceramic powder. Although experience and colloid science can be used for direction, the type and amount of surfactant required to optimize repulsive forces so that the ceramic particles do not agglomerate is usually determined by experiment.

Systematic adsorption, electrokinetic and stability measurements on particulate suspensions containing surfactants establish the necessary chemical (such as pH and ionic strength of the suspension) and the surfactant dosage conditions for obtaining stable suspensions. Detailed adsorption studies determine the maximum surfactant dosage (per unit area of particle surface) that need to be added to the slurry. Electrokinetic measurements determine the sign and the magnitude of the surface potential acquired by the particles in the liquid medium at different surfactant dosages and pH conditions. Stability measurements help to determine the regions of maximum repulsive forces between particles at different surfactant dosages as well as chemical conditions. Such surface chemical studies on each ceramic particulate material in the system help to determine the conditions that produce repulsion between different particulate systems. See, for example, "Surfactants and Interfacial Phenomena", M. J. Rosen, Wiley-Interscience, New York, N.Y., 1978, and "Structure and Performance Relationships in Surfactants", Ed. M. J. Rosen, American Chemical Society Publication, Washington, D.C., 1984, both of which are incorporated by reference.

It is necessary to keep particles of one material from being attracted to the surface of another material. In this case, a surfactant must be chosen that produces repulsive interparticle forces as well as repulsive forces between the particles and the second material.

Figure 5:
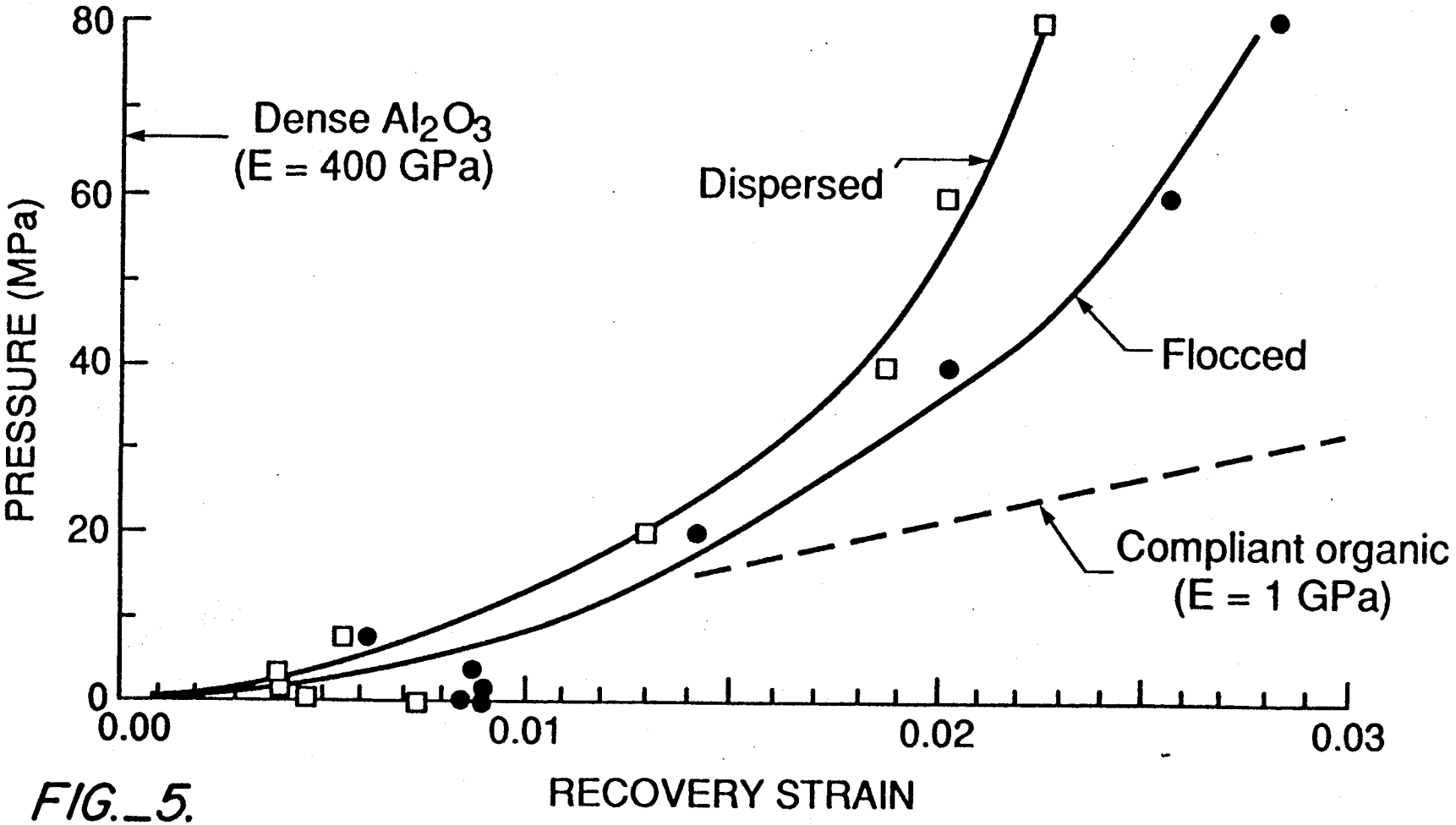
FIG. 5 shows a graph of the total strain recovery plotted as a function of applied pressure for ceramic bodies consolidated from flocced and dispersed alumina slurries and for an organic material

Optimum Rheology—It is now recognized that powders exhibit non-linear elastic stress-strain behavior similar to that described by Hertz for two spheres pressed together. The compressive stress (s)-strain (e) response of the powder can be expressed as $s=Ae^{3/2}$, where A depends on the relative density of the powder compact (average number of contacts per particle) and the elastic properties of the particles. A is independent of particle size. FIG. 5 describes this response for $Al_2O_3$ powder compacts as determined with strain recovery measurements after pressure filtration of both flocced and dispersed slurries. As illustrated, relatively small stresses produce large strains and the compact becomes stiffer as the stress is increased. It is not the porosity that produces this behavior, but the large displacements between particle centers when a 'point' contact is elastically compressed into an area contact. Thus, after a powder has been consolidated and the pressure is released, large elastic strains are recovered and the compact grows.

The greater the consolidation pressure, the greater the recoverable strain. Inclusions within the powder which are either stiffer (e.g. dense agglomerates, whiskers or fibers) or more compliant (organic inclusions) will store less or more strain relative to the powder compact, respectively, during consolidation. FIG. 5 also illustrates the elastic response a very compliant polymer inclusion (E=1 GigaPascal, GPa). The differential strain relieved by the inclusion relative to the powder will produce detrimental stresses during strain recovery.

Figure 6:
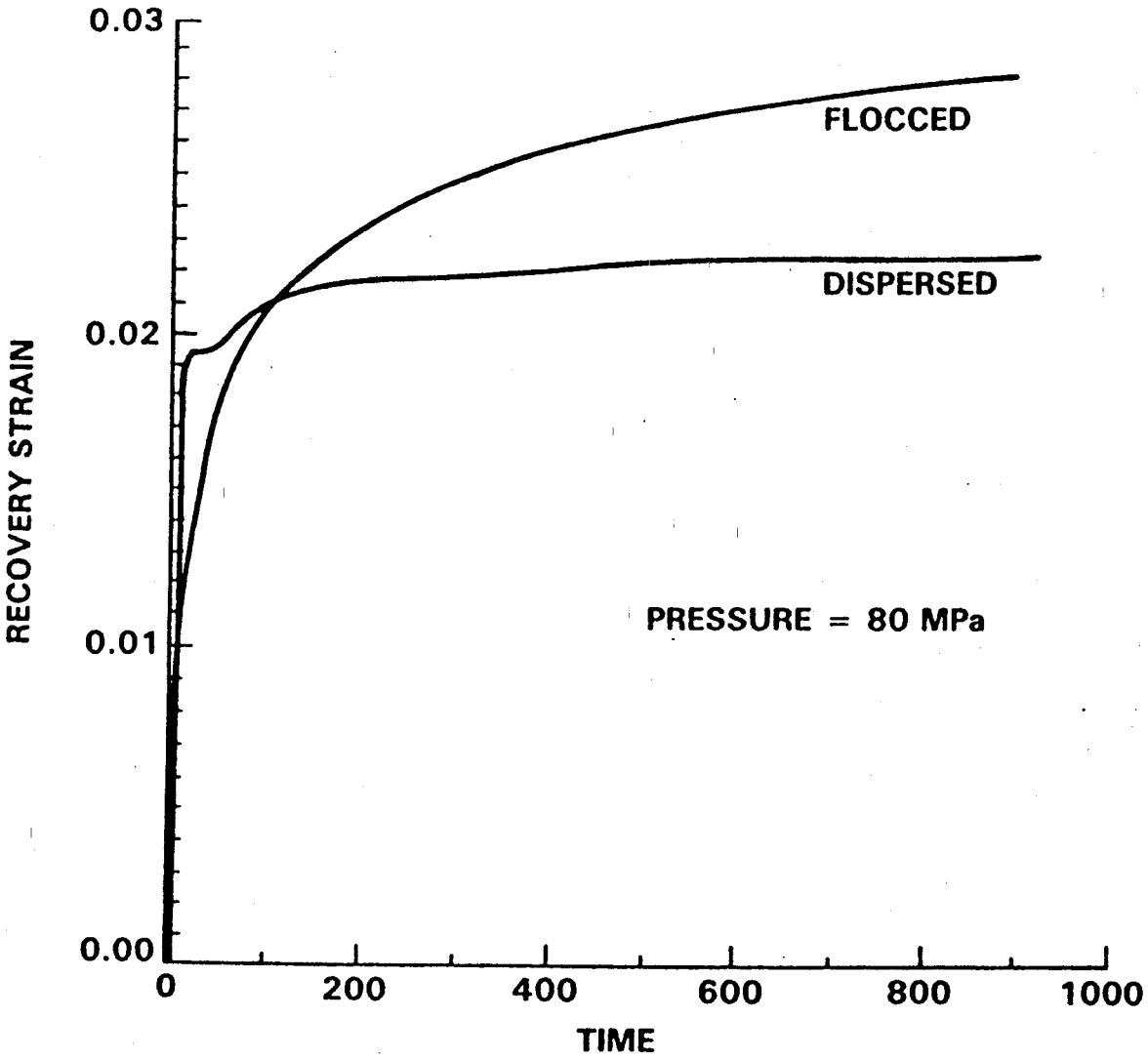
FIG. 6 shows a graph of the time dependent strain recovery for bodies consolidated from flocced and dispersed alumina slurries.

For consolidated dry powders, strain recovery is nearly instantaneous with pressure release. As shown in FIG. 6, the strain recovery for compacts produced by pressure filtration is time dependent, e.g., a compact produced from a flocced (attractive interparticle forces) slurry will continue to release strain and grow many hours after pressure release because the attractive interparticle forces form a very ridged packed, particle network. This time dependent strain release phenomenon arises because fluid (liquid or air) must flow back into the compact to allow the compressed particle network to grow and relieve its stored strain.

FIG. 6 also illustrates that bodies formed with dispersed slurries relieve their stored strain within a much shorter period relative to bodies formed with flocced slurries. The reason for this behavior is that the body formed with the dispersed slurry is still a fluid after pressure filtration, albeit, with a much higher viscosity relative to the initial slurry, i.e., the consolidated body can flow itself to release stored strain after filtration. Bodied formed with dispersed slurries will continue to flow after removal from their die cavity much like 'silly putty' which has similar dilatant rheology.

Figure 7:
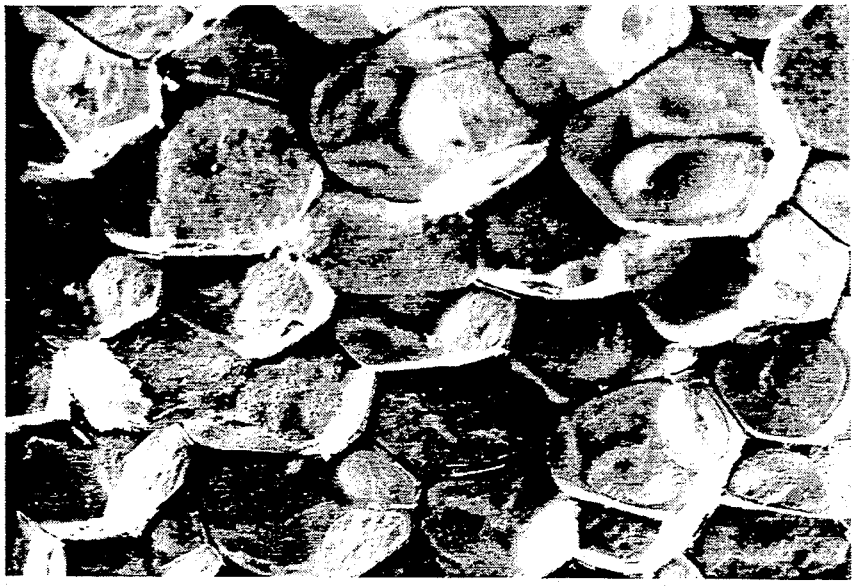
FIG. 7 is a micrograph showing the fractured surface of a densified alumina preform made from a flocculated slurry. The photograph clearly shows that fracture has originates at inter-cell regions.
Figure 8:
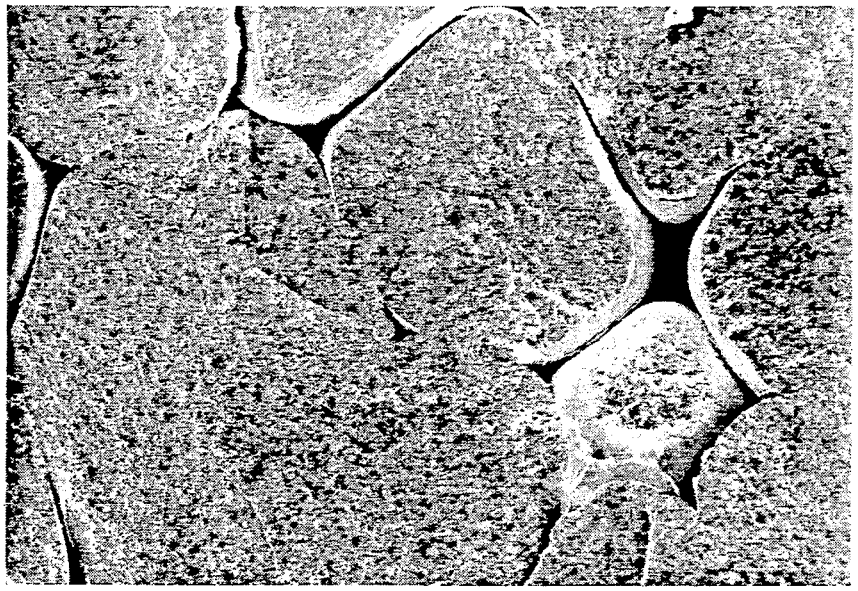
FIG. 8 is a micrograph showing the fractured surface of a densified alumina preform made from a dispersed slurry. The photograph clearly shows that fracture has taken place at intra-cell regions.

The rheological behavior of powder compacts formed during pressure filtration is found to significantly influence the structural integrity of the bodies. A flocced slurry is used to fill a reticulated polymer foam with very large channels by pressure filtration. After the polymer is removed by heat treatment and the ceramic is densified, the body was very weak and broke into granules that defined the cells within the reticulated foam. FIG. 7 illustrates the fracture surface of this material. When a similar body is formed from a dispersed slurry, the resulting dense ceramic is much stronger and the cracks induced by fracture propagated across the pore channels as shown in FIG. 8. The weakness and granulation of the dense body formed from the flocced slurry is caused by the differential recovery strain of the polymer versus the consolidated body when pressure is released after pressure filtration. The polymer network expands more than the consolidated powder, separating the compact into granules, defined by the polymer cells, before the polymer is removed and the ceramic densified. This problem does not arise when the body is consolidated from the dispersed slurry because when pressure is released, the consolidated body flows to accommodate the differential strains produced when the polymer network expands more than the consolidated powder. It is discovered that the disruption produced when the pressure is removed after filtration could be prevented by consolidating with a dispersed slurry and maintaining the particles in a state of repulsion throughout consolidation.

Formation of Pore Channels within Powder Compact-Evaporative Drying

Figure 2B:
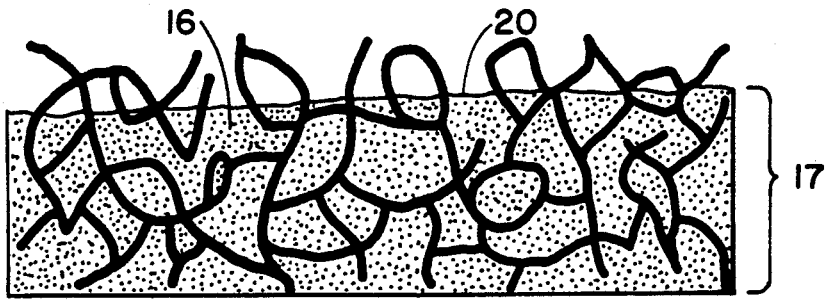
FIG. 2B shows the uncured preform before and after removal of the liquid.

After the powder compact 20 (FIGS. 2A, 2B, 2C and D) (FIG. 2B) containing the network 19 or chopped fibers 9A is formed with either Method 1 or 2 above, is removed from the die cavity, it is fully saturated with liquid. This liquid must be removed, i.e., by evaporative drying from the preform. Preferably the temperature of removal of liquid is between about the freezing and boiling temperatures of the liquid and the time is about 12 to 24 hrs. Especially preferred is a temperature of between about 30° and 60° C., and between about 12 and 15 hrs.

Pyrolysis—After liquid 11 is removed, the pore channels 22 must be formed within the powder compact 20 by removing the network material 19 or chopped fibers 19A. This is accomplished by a heat treatment that causes the organic network 19 or chopped fibers 19A to decompose to gases by heating (pyrolysis). This can be accomplished at temperature between 20° C. and 800° C., depending on the organic material used. Preferably the temperature is between about 200° and 600° C., and the time is between about 1 to 48 hr. Especially preferred is a temperature of between about 200° and 600° C., and between about 2 to 4 hr.

Forming Dense Ceramic Containing Channels for Metal Infiltration

Figure 2C:
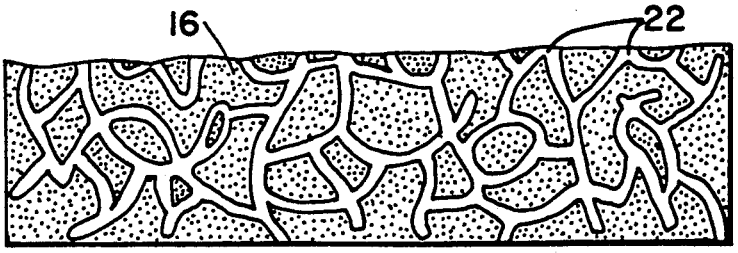
FIG. 2C shows the preform having open channels after pyrolysis of the moiety.
Figure 9:
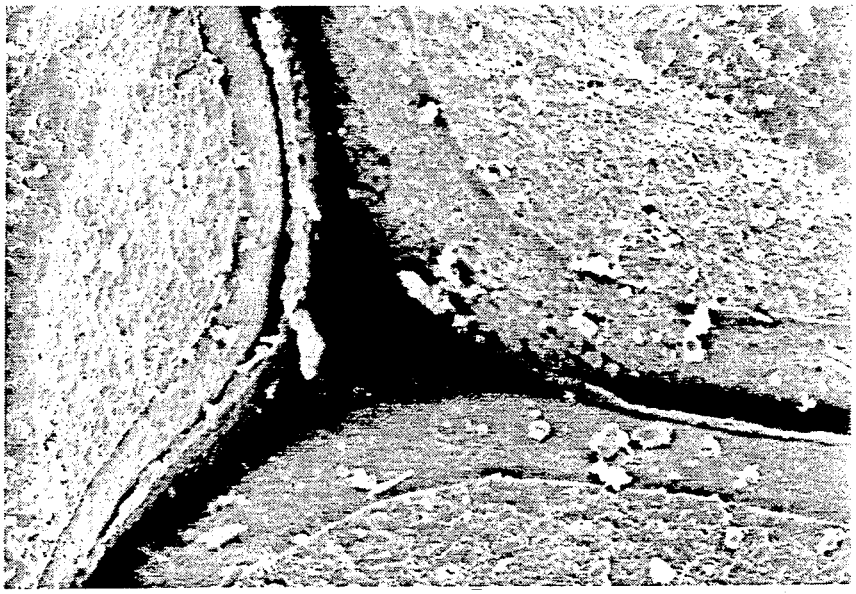
FIG. 9 is a photograph of an open pore channel remaining in the densified ceramic body after all of the polymer has been pyrolyzed away.

The temperatures required to pyrolyze organic materials are usually not sufficient to densify ceramic powders. Thus, after the organic network or chopped fibers are pyrolyzed, the temperature is increased to cause the ceramic powder, containing the open pore channels, to densify. As shown in FIGS. 2C and 9, the dense ceramic still contains the pore channels 12 remnant of the pyrolyzed polymer.

The temperature for densifying a ceramic particulate body is far below its melting point. The sintering temperature for any given ceramic particulate body is proportional to its melting temperature and the particle size. In addition to the sintering temperature, the duration of sintering is equally important in determining the mechanical properties of the ceramic. Prolonged sintering at high temperatures, beyond complete densification, results in a ceramic with coarse grained microstructure. Generally, ceramic bodies with fine grained microstructure, i.e., approximately 1 micron, exhibit superior mechanical properties than a coarse grained material over a wide range of temperatures. In this respect, densified ceramic bodies that are processed using submicron-sized ceramic powder, preferably by colloidal processing routes, are desirable as they generally tend to produce fine grained microstructures. For a wide range of materials listed in Table 1 above, the sintering temperatures range from between about 1200°-800° C., usually between about 1 to 2 hours. See, for example, "Introduction to Ceramics", W. D. Kingery, et al., Wiley-Interscience Publications, New York, N.Y., 1975, which is incorporated herein by reference.

Preferably the temperature of densifying (sintering) is between about 1200° to 1800° C., and the time is between about 0.5 to 24 hr. Especially preferred is a temperature of between about 1200° to 1600° C., and between about 0.5 to 24 hrs.

Metal Infiltration into the Dense Ceramic Containing Defined Pore Channels (FIG. D)

Figure 2D:
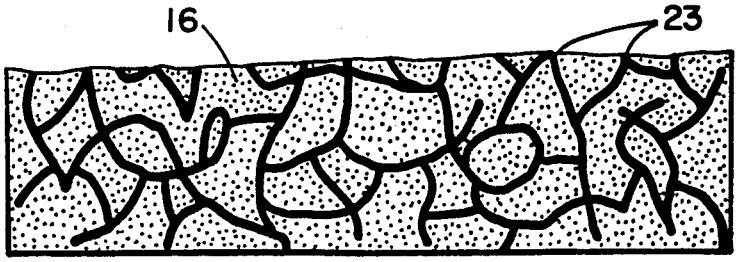
FIG. 2D shows the preform after densification and infiltration of the metal.

Infiltration (intrusion) of the ceramic preform by a liquid metal 23 (pure or alloyed) is performed, FIG. 2D. This infiltration is carried out with or without the application of external pressure. The "wetting" characteristics of the ceramic preform material by the liquid alloy is an important parameter since it affects infiltration by capillary action with or without externally applied pressure. Recognizing that infiltration takes place under capillary action, nevertheless, a preferred embodiment of this invention is to use externally applied pressure on the liquid metal to achieve the infiltration. Sample metals and metal alloys are found in Table 2 below. The advantage of this approach is that infiltration is achieved under relatively short times and subsequent solidification takes place under externally applied pressure which results in a fine-grained metal microstructure free of shrinkage voids, FIG. 2D.

TABLE 2

Metal Reinforcement Materials and Approximate Heat Treatment Temperatures Needed to Optimize their Strength and Deformation Characteristics

| Metal Systems | Max. Melting Temp., °C. | ANNEALING Approx. Heat Treat. Temp., °C. |
|---|---|---|
| Al and Al alloys | 650 | 450 |
| Mg and Mg alloys | 627 | 200-500 |
| Pb and Pb alloys | 326 | 200-300 |
| Cu and Cu alloys | 1080 | 700 |
| Ti and Ti alloys | 1660 | 500-700 |
| Al—Ti Superalloys | 1450 | 750 |
| Nickel Base Superalloys | 1450 | 750 |
| Cobalt Base Superalloys | 1450 | 750 |
| Iron Base Superalloys | 1200 | 750 |
| Zirconium Alloys | 1400 | 600 |

Preferably the ceramic preform is heated to minimize thermal shock, at temperatures greater than the melting point of the metal, see Table 2. When the ceramic preform is alumina, it is heated to about 700° C., and liquid molten aluminum at about 700° C. is used to infiltrate the open channels.

One method of achieving this final compositing step is to preheat the ceramic preform and introduce it to the female die half of a conventional squeeze casting machine. The metal alloy is then melted in a separate crucible and poured on top of the preform. Pressurization of the melt top by the male half of the die (e.g. activated by hydraulic pressure) causes the molten metal to infiltrate (intrude) into the pore channels within the ceramic. Since the ceramic and/or die is at a temperature below the solidus of the metal alloy, complete solidification is achieved under applied pressure preventing formation of shrinkage cavities. Alternate casting processes could include introduction of the ceramic preform in the die cavity of a die casting machine.

An important advantage of the present process is that shaped composites are readily formed by introduction of a shaped ceramic preform in the desired die cavity. The resulting composite can have a uniform structure of ceramic 16 infiltrated with a metal alloy 23, FIG. 2D. Alternatively, composites with a varying microstructures can be produced by selective introduction of ceramic preform or preforms in various locations of the die cavity prior to infiltration. Hybrid composites with a variety of microstructures can thus be fabricated, such as alumina-aluminum, alumina, aluminum-magnesium alloy. These composites are:

(a) composites in which the volume fraction of metal reinforcement varies from the top to the bottom of the article, for example, a piston where metal reinforcement increases 30% to 100% by volume from its hottest to coolest locations during the active service;

(b) composites in which the diameter of the metal reinforcement is varied with position within the article; and (c) composites in which the composition of the ceramic matrix is varied with position with the article, for example, a piston where zirconia is the dominate matrix ceramic near the hottest section and alumina is the dominate matrix material near the coolest portion of the article.

Heat Treatment and Annealing of the Ceramic Metal Matrix Composite Article

After casting the metal in the densified ceramic preform, certain low temperature heat treatment procedures may be needed for the composite in order to enhance its mechanical properties. Such heat treatment procedures include solution annealing, precipitation hardening and recrystallization. For example, an Al with 4% Mg alloy at room temperature contains two phases $\alpha$ and $\beta$. Above 250° C., $\beta$ phase dissolves in phase o to form a solution. Solid precipitation occurs when this alloy is cooled into the two phase temperature range (below 250° C.) after being solution-treated above 250° C. Such precipitation is useful for imparting strength to metals, and the Mg present influences ductility.

Annealing is used to describe softening which accompanies recrystallization of strain-hardened metals. Annealing entails heating a metal to a temperature at which the individual atoms have added freedom for movement and rearrangement into more suitable structure, i.e., a structure with less energy or internal stresses. See, for example, Table 2, or "Properties and Selection of Nonferrous Alloys and Pure Metals", Metals Handbook, 9th Edition, ASM Handbook Series, Metals Park, Ohio (1979), which is incorporated herein by reference.

Another advantage that is associated with heat treating a ceramic-metal composite is the development of an optimal interface between the metal and the ceramic With such an interface, a crack propagation enhances the toughness of the composite.

Other than the steps involving pressure filtration, step (a), and optionally the molten metal infusion, steps (e) and (f), the steps herein are performed without particular regard to the pressure That is to say, the liquid in step (b) is removed at reduced pressure (e.g. freeze drying), ambient or elevated pressure so long as the liquid removal does not disrupt the fragile preform. In a similar manner, organic polymer in the matrix can be removed, by heating, at elevated pressure, ambient or reduced pressure so long as the structure of the preform is not disrupted. The optimum pressure for each combination of liquid ceramic, and polymer (or fiber) can be determined with a limited number of experiments.

In the addition of the molten metal in step (e), the preform is usually heated to an elevated temperature to avoid thermal shock, before addition, to at least as high a temperature as the melting point of the molten metal (or alloy), and preferably about 100° C. higher. More preferably, the temperature is about 50° C. higher, or 20° C. higher. The optimum temperature for each combination of ceramic preform and molten metal can be determined with a limited number of experiments.

Similarly, the molten metal (alloy) is heated to a temperature above its melting point which is effective for the metal to infiltrate the open channels of the densified preform. Usually the temperature is about 5° to 200° C. preferably between about 50° and 100° C. above the melting point of the metal.

Reinforced Ceramic Article

The description for forming the ceramic preform above is incorporated herein by reference. The process is the same except that the reinforcing material is an inorganic or organic or metal fiber which is not pyrolyzed away. The reinforced ceramic articles obtained have improved physical and chemical properties as compared to the non-reinforced ceramic articles. Additional aspects include the following:

Engineering ceramic components are formed by compacting powders into the desired shape. These powder compacts are strengthened by a heat treatment at temperatures which promote rapid mass transport. Depending on the mass transport mechanism, the heat treatment can either form strong bridges between the particles without changing the compact's bulk density, or eliminate the void phase to produce a dense ceramic. For both cases, optimum conditions require that the powder be compacted to the highest packing density possible High packing densities lead to a greater number of bridges between particles and thus a stronger body for the case where densification is not desired. When densification is desired, a high packing density lead to lower densification temperatures and less shrinkage during densification (i.e., less void volume to remove).

The problem in this art concerning composites is how to introduce a powder into a reinforcing preform, and then optimize its packing density without disrupting the preform.

Powders are introduced into preform as a fluid slurry and then packed to their maximum density by a method known as pressure filtration. This processing method requires that particles within the slurry must repel one another and that the particles are not attracted to the preform material. If the particles attract one another within the slurry, they form large agglomerates (commonly known as flocs) which can not penetrate the preform channels. Also, if the particles are attracted to the preform material, they quickly clog surface channels and prevent complete particle penetration and consolidation. Repulsive forces between the particles within the slurry and repulsive forces between the preform material and particles are achieved with the proper selection of a surfactant/liquid system which is incorporated into the initial slurry prior to intrusion into the preform and consolidation by pressure filtration. As discussed herein, this requirement is necessary to keep particles from sticking to a preform when it is infiltrated with a slurry.

The proper surfactant for Examples 1 to 7 below is used to demonstrate the method as described below. A simple technique is disclosed to test if a given surfactant would produce sufficient repulsive forces to allow free flow of the slurry through the preform. This technique involves injecting the surfactant/liquid wetted preform with the slurry plus chosen surfactant/liquid preform with the slurry plus chosen surfactant/liquid system with a syringe. If sufficient interparticle forces are present, the injected slurry freely flows throughout the preform and drips off in the same condition in which it was injected. If the surfactant does not produce the required repulsive surface forces, one can not inject the slurry, i.e., the regions close to the tip of the injecting needle quickly clog to prevent further flow of the slurry. This condition is verified by examining the region close to the needle hole using a scanning electron microscope.

Centrifuqation

For all phrases concerning incorporating and packing powder into a preform (either organic or inorganic) herein, the term "pressure filtration" 11 can be substituted by the phrase: "centrifugation", which is preformed under equivalent gravitational fields from about 1 to 10,000 g's," preferably between about 100 to 2000 g's. That is, centrifugation is another method of packing ceramic powder (in a slurry) into a preform, whether the preform material is later pyrolyzed to form channels for molten metal intrusion or retained as a reinforcement. The proviso is that this formation technique is useful only an organic or inorganic preform. Centrifugation is not recommended for mixed particle slurries (two or more powders mixed together and dispersed) unless the mass partitioning would result in the desired compositional gradient. The general procedure is to place and fix the preform at the bottom of centrifugal cavity, pour slurry into cavity, centrifuge to desired rotational speed, pour off supernate, remove ceramic-filled preform, and then remove liquid by drying. The subsequent procedure described above for the pressure filtration technique is incorporated herein by reference. Because the packing of particles in dispersed state is not effected by centrifugal force, increasing rotational speed only effects time required to pack particles.

The chemicals, materials and reagents used herein are obtained from commercially available sources and are used as obtained from the supplier unless noted otherwise. Typical suppliers include Aldrich Chemical Co., Milwaukee, Wis., Dow Chemical Co., Midland, Mich., and the like. Suppliers are also identified in *Chemical Sources, U.S.A.*, published annually by Directories Publishing, Inc., Columbia, S.C.

The following Examples are meant to be descriptive and illustrative only. These Examples are not to be construed as being limiting in any way.

EXAMPLE 1

Alumina-Aluminum Reinforced Composite Matrix (a) A reticulated polyurethane foam with 40 pores/cm (a product of Scotfoam Corp., Eddystone, Pa., is used as a pyrolyzable, three-dimensional network for processing alumina preforms Upon pyrolysis, the foam introduces interconnected ceramic cells of 250 microns and pore channels of diameter 50 to 80 microns into the preform. Prior to infiltration of a slurry into this foam, the foam is soaked with water (pH-adjusted to$^{-3}$, with or without a surfactant) which ensures that all the air pockets are removed This step fulfills two functions: first, the water within the foam acts as a medium for transporting the slurry to the filter without foam itself acting as a filter during pressure filtration. Second, a ceramic body without entrapped air pockets will eventually be structurally sound (since defects such as air pockets within a ceramic body are deleterious to mechanical properties). The slurry used in this investigation is made up of 20 weight percent alumina (Sumitomo Chemical Co., Tokyo, Japan), in water. The mean particle size of alumina is 0.4 microns. Formulation of the slurry consists of the following steps: (1) mechanically mixing the powder and water (using a standard magnetic stirrer), (2) adjusting the slurry pH to 4.0 (using nitric acid) such that the alumina particles in the slurry are well dispersed, (3) disintegrating the loose agglomerates in the slurry with an uIrasonic horn (Sonic Dismemebrator, Model 300, Fisher Scientific Co., Tustin, Calif.), and (4) finally, adjusting the slurry pH (using nitric acid or ammonia) such that a dispersed or a flocculated slurry is obtained, as per subsequent processing needs. A flocced alumina slurry (pH 8.0) is used for filtration into the reticulated foam. Since they produce fine-grained microstructure, submicron sized alumina is used to form ceramic articles in this study. Depending on particle size the maximum solids loading in the slurry is affected In the present case, a 20 weight percent alumina (0.4 micron) slurry at pH 8.0 is chosen since it can result in a pourable slurry. If the particle size decreases to, say 0.1 micron, in order to get a pourable flocced slurry, it may be necessary to work with a 10 or less weight percent of solids in the slurry. The slurry is carefully poured over the water-soaked foam (pH 8.0) which is already in the pressure filtration apparatus. The pressure is applied for filtration to commence and a maximum pressure of 15 MPa is reached. After the filtration, a wet alumina/foam cake is carefully removed from the die.

Structural damage to pressure cast bodies originates from two sources: first, pressure filtered bodies made from flocculated slurries exhibit non-linear strain recovery once the pressure is removed and second, certain internal stresses are introduced into the cast body as it is being ejected from the die. Therefore, it is necessary to take certain precautions to keep the damage to the pressure filtered bodies to a minimum. The following method elaborates such a procedure: the wet cake is equilibrated for 4–5 hours under 100% water vapor at 50° C., the surface tension and viscosity of water are 7% and 45% lower when compared to those properties measured at room temperature (20° C.). Since the surface tension of water is less, the capillary pressure within the particle interstices is also lower (as per the Laplace equation). Also, because of lower viscosity of water, the relative viscosity of the water-saturated cake also decreases. These two factors contribute, under 100% water vapor, to a less rigid, and a relatively fluid cake under which internal stresses within the body are effectively released.

After equilibration, the water saturated cake is dried at 50° C. for 24 hours. The next step is to form the pore channels by removing the foam within the powder compact. This is accomplished by burning or pyrolyzing the polymer at 200°–350° C. and later heating the powder compact to 800° C. to ensure complete removal of residual carbon. Since the temperatures used for polymer burning are not high enough to densify the ceramic body, the powder compact is then heated to 1550° C. (for 30 minutes). Such a heat treatment procedure results in a dense ceramic body having the pore channels remnant of the pyrolyzed polymer. The typical relative density of such a porous ceramic body is 85% by volume.

A fractured micrograph of the alumina preform (made from a flocculated slurry) with polygon-shaped cells in shown in FIG. 7. The microstructure also shows that the cells are orderly surrounded by smooth edged channels. The micrograph also shows that the fracture has originated at inter-cell regions. Examination of the cell surface at higher magnification reveals that any two adjacent cells are being joined by about 10% of the available area. This may have resulted from differential strain recovery of the powder compact and the polymer during processing.

(b) The flocced slurry procedure described in Example 1(a) is suitable for working with either coarse particles (for example, less than 10 microns) and/or multicomponent ceramic systems. When working with coarse particulate suspensions, flocculation is necessary to prevent the particles from sedimentation or segregation during pressure filtration. On the other hand, while working with binary, ternary, quarternary and pentanary ceramic systems, invariably it is difficult to find common operating conditions at which all the components of the system repel one another.

Since ceramic preforms that are made from flocced slurries experience excessive internal damage due to differential strain recovery between the foam and the consolidated ceramic body, it is necessary to explore the possibility of minimizing such damage by added certain chemical agents during processing. One of such methods is to add certain long chain polymers capable of providing lubrication between particles when the particles are being pressed together during pressure filtration. The other method is to add certain polymeric binders, such a polyvinyl alcohol (PVA) to the slurry, such that the polymer form bridges at particle-particle contact regions in the compact and resist excessive strain recoveries.

EXAMPLE 2

Improved Method for Making Alumina Matrix/Aluminum Reinforced Composite (a) Instead of using a flocculated suspension (as in Example 1), a dispersed alumina suspension (pH 3) is used for infiltration into Scotfoam soaked with water (pH 3). The procedures for pressure filtration, equilibration and heat treatment were the same as in Example 1.

Figure 10:
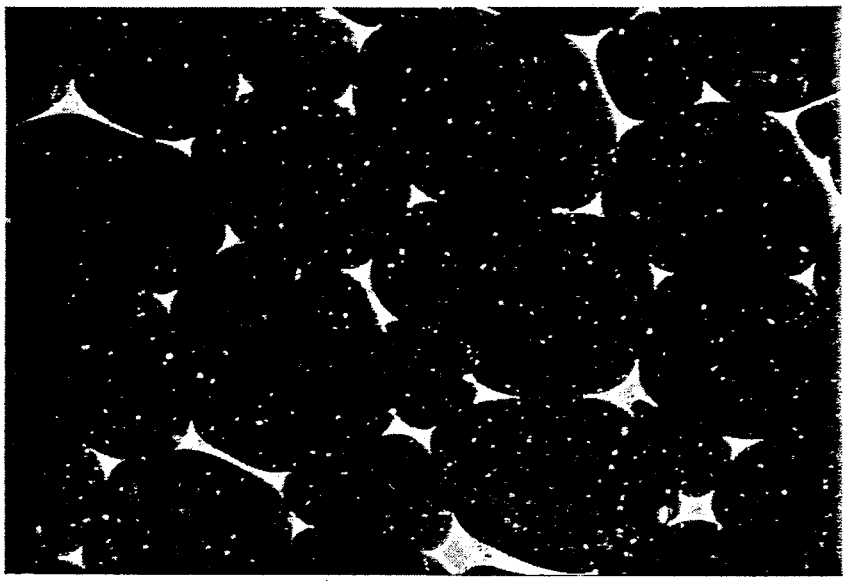
FIG. 10 is a photograph of the sectioned and polished surface of alumina matrix-aluminum composite article showing complete infiltration of the metal into all of open channels (that are remnant of the foam) of the densified preform.
Figure 10A:
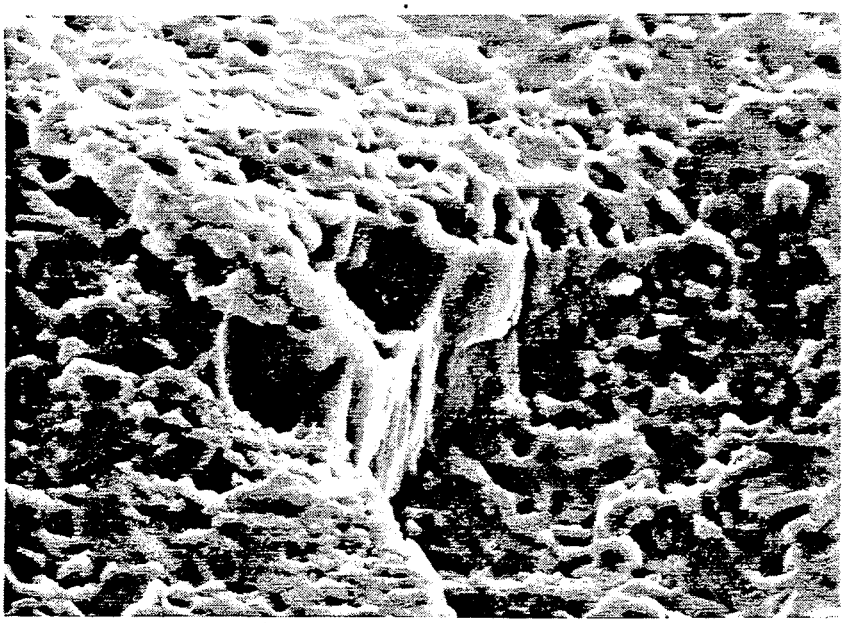
FIG. 10A is a micrograph of fractured alumina-aluminum alloy composite article which is produced as per Example 2(a). The figure clearly shows aluminum alloy phase pullout (as a result of plastic deformation) during fracture.

The micrograph of the fractured surface of the preform (made from a dispersed slurry) exhibiting intra-cell fracture is given in FIG. 8. Unlike the preform made with a flocculated slurry (Example 1), this preform is stronger since two adjacent grains are in contact with each other. This strength is a direct result of dilatant rheology of the pressure cast cake which facilitated complete strain recovery of the powder compact during processing. Because of the superior structural integrity, the preform made with a dispersed slurry had a relative density of about 90% after removal of the Scotfoam and densification. This preform is infiltrated with Al-Mg alloy and its microstructure is shown in FIG. 10. The metal content of this composite is about 10% by volume. FIG. 10A shows a micrograph of fracture surface of the alumina/aluminum composite. FIG. 10A clearly shows aluminum alloy phase pullout (as a result of plastic deformation) during fracture.

(b) Instead of using dispersed alumina of Example 2(a), 3 mole percent $Y_2O_3$ stabilized $ZrO_2$ (Toyo Soda USA, Inc., Kyocera America, Inc., San Diego, Calif.) is used for ceramic infiltration into Scotfoam soaked with water (pH 3). The procedure for pressure filtration, equilibration and heat treatment are the same as in Example 2(a). However, the densification temperature and time are 1400° C. and 2 hours. Final infiltration of molten metal into the densified preform is achieved by following the same procedure as in Example 2(a).

(c) Instead of using alumina, including but not limited to 1:1 ratio of $ZrO_2$ and $Al_2O_3$ or $Al_2O_3$ and SiC whiskers are used in the procedure described in Example 2(a). Final infiltration of molten metal into the densified preform is achieved by following the same procedure as in Example 2(a).

(d) Instead of alumina, silicon (less than 2 microns) dispersed in water a pH 8 is infiltered into Scotfoam soaked with water (pH 8). The procedure for filtration, equili-bration and low temperature heat treatment are the same as in Example 2(a). However, the final densification is achieved by reacting silicon with nitrogen gas at high temperatures (1300° C.) and pressures (2 atmospheres) for 24 hours. Such reaction not only transforms silicon into silicon nitride, but also reaction bonds silicon nitride to form a dense compact. Silicon nitride is one of the structural ceramic materials that is used at high temperatures. Final infiltration of molten metal (Al-Mg) into the densified preform is achieved by following the procedure same as in Example 2(a).

(e) Another form of reaction bonding is obtained by mixing ceramic constitutents in stoichiometry to form a phase that possess the qualities of structural material. In the present case, instead of using alumina, stoichiometric quantities of $Al_2O_3$ and $SiO_2$ is used to make mullite ($3Al_2O_3$-$2SiO_2$). While the procedure for pressure filtration, equilibration and low temperature heat treatment are same as in the Example 2(a) preform, the final densification and phase transformation are achieved at 1500° C. for 4 hours. Final infiltration of molten metal (Al-Mg) into the densified preform is achieved by following the procedure described in Example 2(a).

(f) Al-Mg alloy in Example 2(a) are substituted with, including but not limited to Al-Cu, Al-Ti and other alloys listed in Table 2. The corresponding ceramic metal matrix article is obtained.

(g) Al-Mg alloy used in Example 2(b), 2(c), 2(d), 2(e) and 2(f) is substituted with each alloy listed in Table 2. The corresponding ceramic metal matrix composite article is obtained.

EXAMPLE 3

Figure 11:
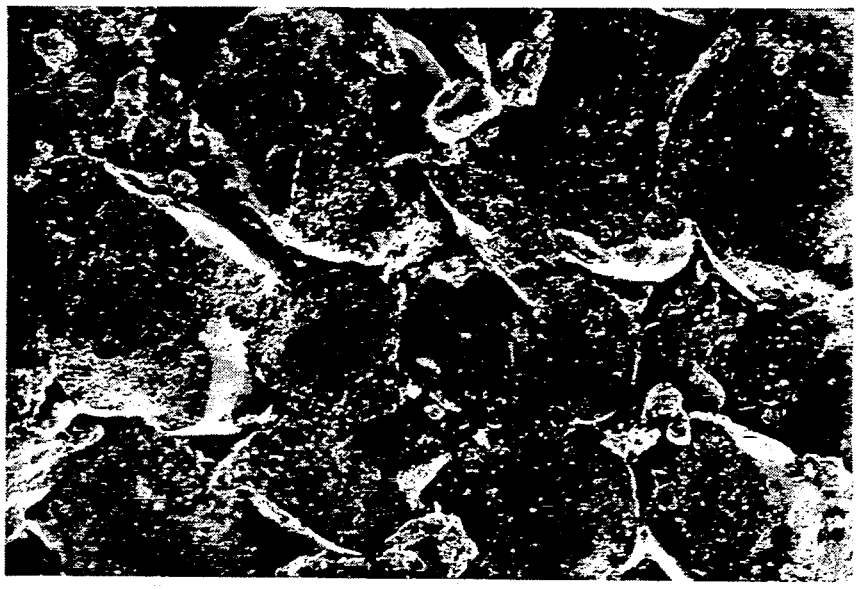
FIG. 11 is a photograph of the fractured surface of an alumina preform made with a high density polyurethane foam showing a fine interconnected cell structure.
Figure 12:
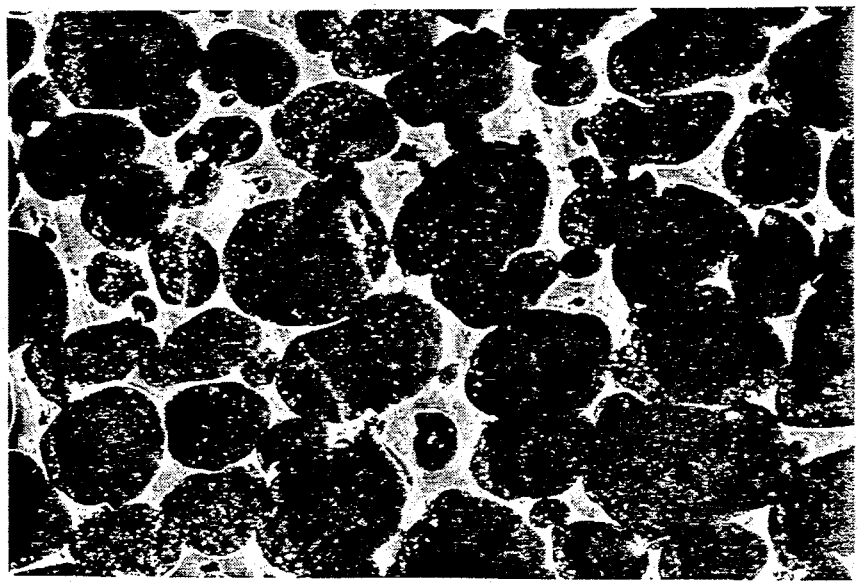
FIG. 12 is a micrograph of aluminum alloy infiltrated alumina preform (made with a high density organic polymer foam) showing a higher proportion of metal content in the composite article.

Alumina Matrix-Aluminum Reinforced Composite with Enhanced Metal Content (a) Controlling the metal to ceramic content of a composites contributes to enhanced mechanical properties. Therefore, in the present process such control of the preform porosity is achieved in a least difficult way, i.e. by choosing a foam with desired apparent density or porosity. In the present study, a reticulated polyurethane foam with about 160 pores/cm is used to impart continuous, three dimensional channels into the alumina preform. This preform is pressure filtered with dispersed alumina, and is equilibrated and heat treated as per Example 1(a). The microstructural details of such an alumina preform is shown in FIG. 11. This preform is also infiltrated with molten Al-Mg alloy and its microstructures is shown in FIG. 12. As can be seen from the FIG. 12, the Al alloy uniformly surrounds the alumina grains.

(b) Instead of using dispersed alumina of Example 2(a), 3 mole percent $Y_2O_3$ stabilized $ZrO_2$ (Toyo Soda USA, Inc., Kyocera America, Inc., San Diego, Calif.) is used for infiltration into Scotfoam soaked with water (pH3). The procedure for pressure filtration, equilibration and heat treatment are the same as in Example 2(a). However, the densification temperature and time are 1400° C. and 2 hours. Final infiltration of molten metal into the densified preform is achieved by following the same procedure as in Example 2(a).

(c) Instead of using alumina, including but not limited to a 1:1 ratio of $ZrO_2$ and $Al_2O_3$ or $Al_2O_3$ and SiC whiskers are used in the procedure described in Example 2(a). Final infiltration of molten metal (Al Mg) into the open channels of the densified preform is achieved by following the same procedure as in Example 2(a).

(d) Instead of alumina, silicon (less than 2 microns) dispersed in water a pH8 is infiltered into Scotfoam soaked with water (pH8). The procedure for filtration, equilibration and low temperature heat treatment are the same as in Example 2(a). However, the final densification is achieved by reacting silicon with nitrogen gas at high temperatures (1300° C.) and pressures (2 atmospheres) for 24 hours. Such reaction not only transforms silicon into silicon nitride, but also reaction bonds silicon nitride to form a dense compact. Silicon nitride is one of the structural ceramic materials that is used at high temperatures. Final infiltration of molten metal (Al Mg) into the open channels of the densified preform is achieved by following the procedure same as in Example 2(*a*).

(e) Another form of reaction bonding is obtained by mixing ceramic constitutents in stoichiometry to form a phase that possess the qualities of structural material. In the present case, instead of using alumina, stoichiometric quantities of $Al_2O_3$ and $SiO_2$ is used to make mullite ($3Al_2O_3$-$2SiO_2$). While the procedure for pressure filtration, equilibration and low temperature heat treatment are same as in the Example 2(a) preform, the final densification and phase transformation are achieved at 1500° C. for 4 hours. Final filtration of molten metal (Al Mg) into the open channels of the densified preform is achieved by following the procedure described in Example 2(a).

(f) Al-Mg alloy in Example 2(a) are substituted with, including but not limited to Al-Cu, Al-Ti and other alloys listed in Table 2. The corresponding ceramic metal matrix article is obtained.

(g) Al-Mg alloy used in Example 2(b), 2(c), 2(d), 2(e) and 2(f) is substituted with each alloy listed Table 2. The corresponding ceramic metal matrix composite article is obtained.

EXAMPLE 4

Figure 13:
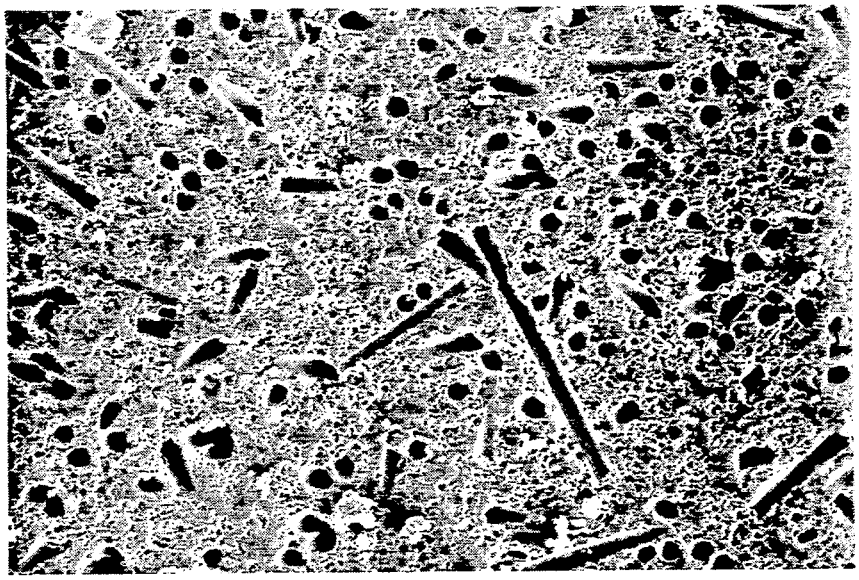
FIG. 13 is a micrograph of the fractured surface of an alumina preform made with 30 volume percent of chopped carbon fibers.
Figure 14:
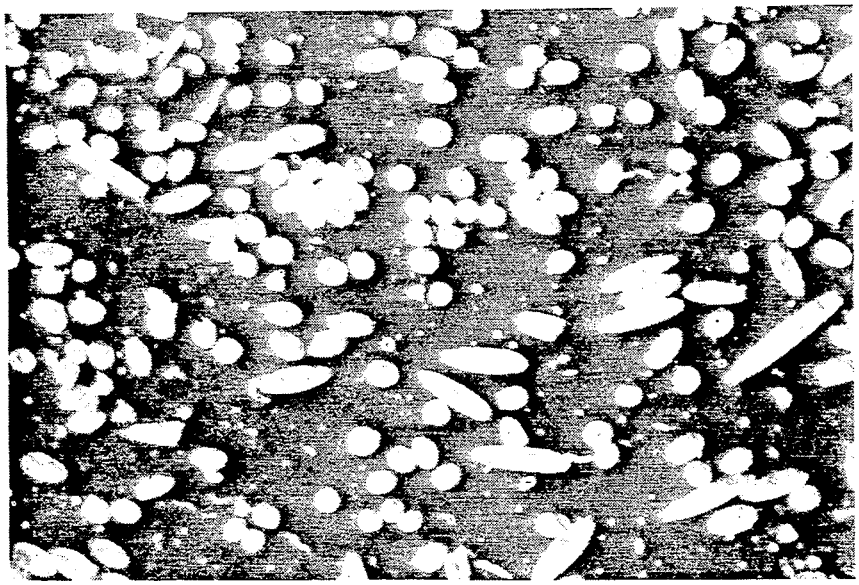
FIG. 14 is a micrograph of an aluminum alloy (A1-4% Mg) as infiltrated into an alumina preform (made from chopped carbon fibers and then pyrolyzed) showing the complete infiltration of the metal alloy into all open channels in the densified preform.
Figure 15:
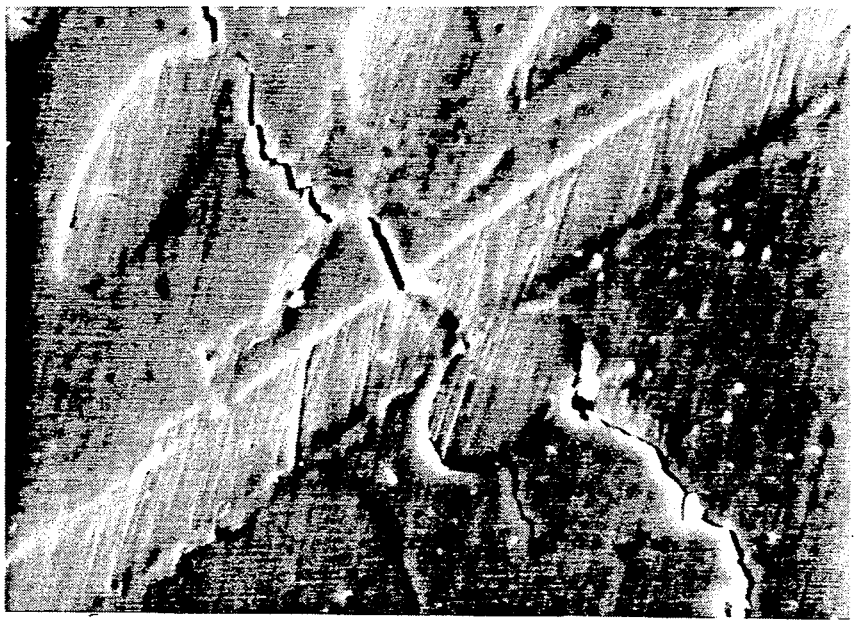
FIG. 15 is a micrograph of an indention crack in alumina-aluminum alloy (A1-4% Mg) composite article. The aluminum alloy phase in the wake of the crack is intact.
Figure 15A:
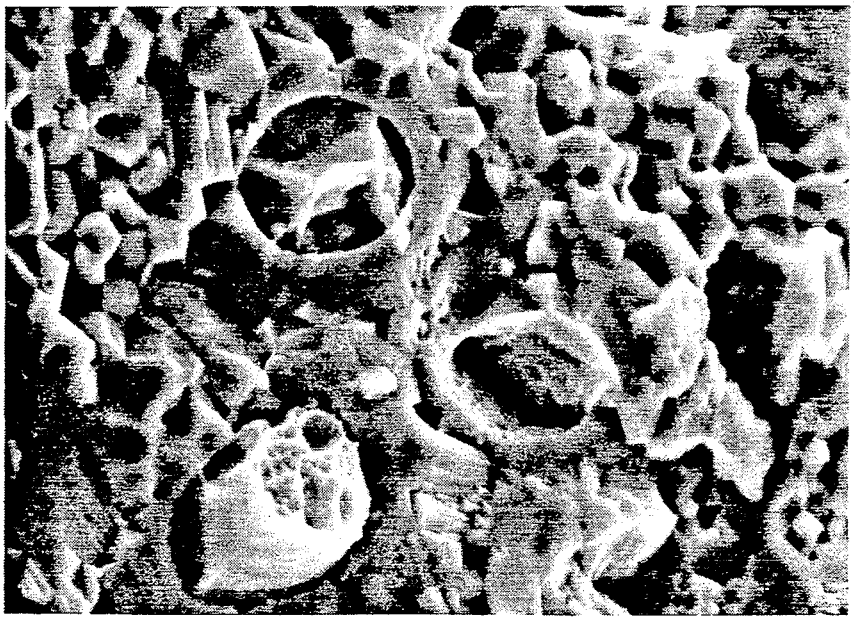
FIG. 15A is a micrograph of fractured alumina-aluminum alloy composite article which is produced as per Example 4(a). The figure clearly shows aluminum alloy phase pullout (as a result of plastic deformation) during fracture.

Ceramic Matrix/Metal Reinforced Composite Aluminum Fibers Reinforcement (a) Instead of using reticulated polymer as a network-former in alumina, in this series of experiments, chopped carbon fibers (length and diameter were 80 and 10 microns, respectively) are used. Prior to infiltration, fibers and alumina (0.4 microns) are dispersed in water in the presence of a surfactant (pH 9.0). After 20 minutes of ultrasonication, the slurry is pressure filtered at about 30 MPa. Later, the pressure filtered cake is dried followed by pyrolyzing the carbon at 800° C. for 4 hr. and then densifying alumina at 1550° C. for 30 minutes. Our experiments show that a continuous/interconnected channel is achieved at 30 volume percent fibers. The relative density of such a preform is 70% by volume, and its microstructure is shown in FIG. 13. The preform is also infiltrated with molten Al-4%Mg alloy and its microstructures are shown in FIG. 14. The fracture behavior of this composite material is investigated by examining the indentation induced crack surfaces with a scanning electron microscope. Examination of the crack surface shows brittle failure of $Al_2O_3$ and Al alloy in the crack wake (FIG. 15) with extensive deformation of aluminum phase. FIG. 15A shows a micrograph of the fracture surface of the alumina/aluminum composite. The figure clearly shows aluminum alloy fiber pullout (as a result of plastic deformation) during fracture. (b) Instead of using dispersed alumina of Example 2(a), 3 mole percent $Y_2O_3$ stabilized $ZrO_2$ (Toyo Soda USA, Inc., Kyocera America, Inc., San Diego, Calif.) is used for infiltration into Scotfoam soaked with water (pH3). The procedure for pressure filtration, equilibration and heat treatment are the same as in Example 2(a). However, the densification temperature and time are 1400° C. and 2 hours. Final infiltration of molten metal into the densified preform is achieved by following the same procedure as in Example 2(a).

(c) Instead of using alumina, including but not limited to a 1:1 ratio of $ZrO_2$ and $Al_2O_3$ or $Al_2O_3$ and SiC whiskers are used in the procedure described in Example (a). Final infiltration of molten metal into the open channels of the densified preform is achieved by following the same procedure as in Example 2(a).

(d) Instead of alumina, silicon (less than 2 microns) dispersed in water a pH a8 is infiltered into Scotfoam soaked with water (pH 8). The procedure for filtration, equili-bration and low temperature heat treatment are the same as in Example 2(a). However, the final densification is achieved by reacting silicon with nitrogen gas at high temperatures (1300° C.) and pressures (2 atmospheres) for 24 hours. Such reaction not only transforms silicon into silicon nitride, but also reaction bonds silicon nitride to form a dense compact. Silicon nitride is one of the structural ceramic materials that is used at high temperatures. Final infiltration of molten metal into the densified preform is achieved by following the procedure same as in Example 2(a).

(e) Another form of reaction bonding is obtained by mixing ceramic constitutents in stoichiometry to form a phase that possess the qualities of structural material. In the present case, instead of using alumina, stoichiometric quantities of $Al_2O_3$ and $SiO_2$ is used to make mullite ($3Al_2O_3$-$2SiO_2$). While the procedure for pressure filtration, equilibration and low temperature heat treatment are same as in the Example 2(a) preform, the final densification and phase transformation are achieved at 1500° C. for 4 hours. Final filtration of molten metal into the densified preform is achieved by following the procedure described in Example 2(a).

(f) Al-Mg alloy in Example 2(a) are substituted with, including but not limited to Al-Cu, Al-Ti and other alloys listed in Table 2. The corresponding ceramic metal matrix article is obtained.

(g) Al-Mg alloy used in Example 2(b), 2(c), 2(d), 2(e) and 2(f) is substituted with each alloy listed Table 2. The corresponding ceramic metal matrix composite article is obtained.

EXAMPLE 5

Alumina Powder/Saffil Fiber Preform (a) Dispersed alumina slurry is produced via a sedimentation/dispersion procedure. Commercial alumina powder (Sumitomo AKP-30; mean size 0.41 microns) is dispersed in nitric acid solution at pH 2. The slurry is ultrasonicated for 15 minutes to insure maximum particle dispersion and then sedimented for 24 hours to allow separation of large agglomerates from the fine particles. After sedimentation, the supernatant containing the fine particle is collected. From the supernatant, a dispersed fine slurry with a loading of 12.5±0.2 volume percent is prepared for infiltration.

In the 15 volume percent alumina fiber preform, the repulsive infiltration requirement for keeping particles from being attracted to the preform is demonstrated. The first preform is soaked in pure de-ionized water. Particle clogging is expected and is observed with this preform treatment since the Saffil fibers do not have the required repulsive electrostatic double layer forces on the surfaces to prevent the alumina particles from being attracted to the preform. Consequently, the approximately 90 percent of the alumina particles in the slurry collected as a layer on top of the preform (i.e., the preform acted as a filter) and led to the subsequent crushing of the un-infiltrated porous preform by the plunger during the last stage of filtration.

(b) In a second case, the preform of part (a) is pretreated with nitric acid solution, the repulsive electrostatic force on the fibers' surface is strong enough to repel the alumina particles and allow infiltration to proceed smoothly. Infiltration is carried out by slowly increasing the applied pressure to 8.0±0.2 MPa. The preform is infiltrated homogeneously to 56±3 volume percent of the available pore volume in the preform. The final compact has a relative density of 71±3 volume percent.

(c) Example 5 (a) is repeated except that the alumina particles are substituted with $ZrO_2$ stabilized with 3 mole percent $Y_2O_3$ (Toyo Soda USA, Atlanta, Ga.).

EXAMPLE 6

Silicon Powder/Carbon Felt Preform (a) Silicon powder (KemaNord grade 4E, from median particle size about 3 microns) is dispersed in both water (pH 9) and pure ethanol. Two carbon felt preforms (about 4.5 volume percent dense) are prepared: one soaked in water (at a pH 9 using ammonia) and the other in pure ethanol.

The silicon slurry is not infiltrated into the preformed soaked in water (pH 9 using ammonia). The silicon particles collect on the top surface of the preform, i.e., the preform acts as a filter. The resultant specimen consists of a crushed carbon felt preform on the bottom and a silicon powder layer on top. This behavior is again representative of the case where the particles are attracted to each other, and therefore cause the clogging of channels within the preform. Thus, although repulsive interparticle forces is achieved between silicon particles water at pH 9 using ammonia, the silicon particles are attracted to the carbon preform fibers under these same conditions.

(b) In the second case where ethanol is used as the fluid to both disperse silicon particles and pretreat the carbon preform, the silicon is easily infiltrated the carbon felt to fill approximately 50 volume percent of the available void space. The repulsive force generated by ethanol is effective in both producing repulsive forces between the silicon particles and between the silicon particles and the carbon preform.

EXAMPLE 7

Silicon Powder/Thronel Carbon Fiber Preform (a) KemaNord (grade 4E) silicon powder (median size about 1.5 micron) dispersed in ethanol is produced using the dispersion/sedimentation method described previously. 18±1 volume percent Thornel (T-75) carbon fiber preform is produced by pressure filtering chopped carbon fibers in ethanol. The silicon slurry is infiltrated into the carbon preform and a green compact with overall relative green density of 57 volume percent is obtained. The compact is then nitrided in nitrogen to convert silicon into silicon nitride. The nitride compact has a final relative density of 66±1 volume percent.

(b) Instead of silicon and Thornel (T-75) fiber system used in Example 7(a), either alumina-alumina fiber (FP-fibers, E.I. duPont de Nemous & Co., Wilmington, Del.) or alumina-mullite fiber (Nextel fibers, 3M Co., Ceramic Materials Dept., Saint Paul, Minn.) systems are used to make ceramic reinforced composites.

While only a few embodiments of the invention have been shown and described herein, it will become apparent to those skilled in the art that various modifications and changes can be made in the process to produce a reinforced ceramic composite article or a ceramic-metal matrix composite article or the improved article produced thereby without departing from the spirit and scope of the present invention. All such modifications and changes coming within the scope of the appended claims are intended to be carried out thereby.

We claim:

1. A method for forming a dense ceramic-metal matrix article, which comprises:
   (a) combining using pressure filtration,
   a liquid slurry of ceramic powder, and
   a pyrolyzable moiety selected from:
      (i) an open cell reticulated organic polymeric foam, or
      (ii) organic fiber, either of which form an interconnected organic network within the ceramic-fiber powder compact produced;
   (b) removing the liquid portion from the compact of step (a) under conditions effective to remove the liquid without disrupting the shape or mechanical integrity of the ceramic powder-organic moiety compact.
   (c) removing the pyrozable moiety by heating the ceramic powder-organic compact at elevated temperature conditions effective to remove the organic moiety without disrupting the shape or mechanical integrity of the ceramic powder compact thus producing the inter-connected network of open channels in the ceramic powder compact
   (d) densifying the ceramic powder compact by heating at a temperature effective to densify the powder without eliminating the open channels:
   (e) heating the densified ceramic preform of step (d) to a temperature effective to prevent thermal shock when next contacted with sufficient molten metal to effectively infiltrate and fill the open channels:
   (e') contacting and infiltrating the porous ceramic preform of step (e) with sufficient molten metal to effectively fill the open channels;
   (f) using increased pressure to facilitate the molten metal intrusion into the open channels of the preform; and
   (g) cooling the formed ceramic-metal matrix article.

2. The method of claim 1 wherein in step (f) increased pressure of between about 1 and 100 megapascals (MPa) is used.

3. The method of claim 1 wherein in step (a) the pressure filtration is performed a pressure of between about 1 atmosphere and 30 MPa and at a temperature between the freezing point and the boiling point of the liquid.

4. The method of claim 3 wherein the temperature of the pressure filtration is between about 10° and 90° C.

5. The method of claim 3 wherein in step (a) the organic liquid comprises water, or at least one organic liquid, or mixtures thereof.

6. The method of claim 5 wherein the liquid is water.

7. The method of claim 5 wherein the liquid is a mixture of water and an organic liquid selected from ethanol, chloroform, alkanes, cycloalkanes or mixtures thereof.

8. The method of claim 1 wherein in step (a) the organic polymeric foam is selected from polyurethane polystyrene, polyethylene, polypropylene, polyester, polyamide, or mixtures thereof.

9. The method of claim 1 wherein the pyrolyzable moiety is selected from a carbon fiber or an organic fiber.

10. The method of claim 1 wherein the ceramic powder is selected from alumina, silica, magnesia, titania, zirconia, silicon nitride, silicon carbide, silicon, boride, boron carbide, yttrium oxide or chemical or physical mixtures thereof.

11. The method of claim 1 wherein in step (a) the ceramic powder particles are between at least about 3 to more than about 10 times smaller than percolation channels created by the pyrolyzable moiety.

12. The method of claim 1 wherein in step (a) the ceramic particles and the network pyrolyzable moiety each have repulsive surface forces effective to prevent agglomeration.

13. The method of claim 12 wherein in step (a) the composition further includes a surfactant effective to produce the necessary repulsive forces.

14. The method of claim 13 wherein the surfactant is selected from polyethylene oxide, polyacrylamide polyacrylic acid, hydrolyzed polyacrylamide, polystyrene sulfonate, polydiallyldimethylammonium, succinamide, pyridine or mixtures thereof.

15. The method of claim 1 which further includes: step (f') concurrently after intrusion of step (f) and before step (g) cooling to ambient temperature, heat treating the ceramic-metal composite an elevated temperature and time effective to optimize the strength and ductility of the metal reinforcement portion of the composite and optimize the physical and chemical properties of the ceramic/metal interface.

16. The method of claim 1 which further includes after intrusion of step (f) and cooling to ambient temperature in step (g):
   step (h) re-heat treating the ceramic-metal composite at an elevated temperature and for a time effective to optimize the strength and ductility of the metal reinforcement portion of the composite and optimize the physical and chemical properties of the ceramic/metal interface.

17. A method for forming a dense ceramic-metal matrix article, which comprises:
   (a) combining using pressure filtration, a liquid slurry of a ceramic powder, and a pyrolyzable moiety selected from:

(i) an open cell reticulated organic polymeric foam or (ii) organic fiber, either of which form an interconnected organic network within the ceramic-fiber powder compact produced;

(b) removing a liquid portion from the compact of step (a) under conditions effective to remove the liquid without disrupting the shape or mechanical integrity of the ceramic powder-organic moiety compact;

(c) removing the pyrolyzable moiety by heating the ceramic powder-organic compact at elevated temperature conditions effective to remove the organic moiety without disrupting the shape or mechanical integrity of the ceramic powder company thus producing an inter-connected network of open channels in the ceramic powder compact;

(d) densifying the ceramic powder compact by heating at a temperature effective to densify the powder without eliminating the open channels;

(e) heating the densified ceramic preform of step (d) to a temperature effective to prevent thermal shock when next contacted with sufficient molten metal to effectively, infiltrate and fill the open channels;

(e') contacting and infiltrating the porous ceramic preform of step (d) with molten metal;

(f) using ambient pressure to facilitate the molten metal intrusion into the open channels; and (g) cooling the formed ceramic-methal matrix article.

18. The method of claim 17 wherein the step (a) the filtration is performed at a temperature between the freezing point and the boiling point of the liquid.

19. The method of claim 18 wherein the temperature of the pressure filtration is between about 10° and 90° C.

20. The method of claim 19 wherein in step (a) the organic liquid comprises water, at least one organic liquid, or mixtures thereof.

21. The method of claim 20 wherein the liquid is water.

22. The method of claim 21 wherein the liquid is a mixture of water and an organic liquid selected from ethanol, chloroform, alkanes, cycloalkanes or mixtures thereof.

23. The method of claim 17 wherein in step (a) the organic polymeric foam is selected from polyurethane, polystyrene, polyethylene, polypropylene, polyester, polyamide, or mixtures thereof.

24. The method of claim 17 wherein the pyrolyzable moiety is selected from a carbon fiber or an organic fiber.

25. The method of claim 17 wherein the ceramic powder is selected from alumina, silica, magnesia, titania, zirconia, silicon nitride, silicon carbide, silicon boride, boron carbide, yttrium oxide or chemical or physical mixtures thereof.

26. The method of claim 17 wherein step (a) the ceramic powder particles are between at least about 3 to more than about 10 times smaller than percolation channels created by the pyrolyzable moiety.

27. The method of claim 17 wherein step (a) the ceramic particles and the network pyrolyzable moiety each have repulsive surface forces effective to prevent agglomeration.

28. The method of claim 17 wherein in step (a) the composition further includes a surfactant effective to produce the necessary repulsive forces.

29. The method of claim 18 wherein the surfactant is selected from polyethylene oxide, polyacrylamide polyacrylic acid, hydrolyzed polyacrylamide, polystyrene sulfonate, polydiallyldimethylammonium, succinamide, pyridine or mixtures thereof.

30. The process of claim 17 which further includes:

step (f') after intrusion of step (f) and before step (g) cooling to ambient temperature, heat treating the ceramic-metal composite an elevated temperature and time effective to optimize the strength and ductility of the metal reinforcement portion of the composite and optimize the physical and chemical properties of the ceramic/metal interface.

31. The process of claim 26 which further includes after intrusion of step (f) and cooling to ambient temperature in step (g):

step (h) re-heat treating the ceramic-metal composite an elevated temperature and for a time effective to optimize the strength and ductility of the metal reinforcement portion of the composite and optimize the physical and chemical properties of the ceramic/metal interface.

* * * * *